US012669126B2

(12) United States Patent
Mahure et al.

(10) Patent No.: US 12,669,126 B2
(45) Date of Patent: Jun. 30, 2026

(54) COMPRESSOR HAVING SHUTDOWN VALVE ASSEMBLY

(71) Applicant: Copeland LP, Sidney, OH (US)

(72) Inventors: Yogesh S. Mahure, Pune (IN); Nikhil Naik, Pune (IN); Mohak Behl, Pune (IN)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/753,630

(22) Filed: Jun. 25, 2024

(65) Prior Publication Data

US 2025/0052244 A1 Feb. 13, 2025

(30) Foreign Application Priority Data

Aug. 8, 2023 (IN) ..... 202321053150

(51) Int. Cl.
*F04C 29/12* (2006.01)
*F04C 18/02* (2006.01)

(52) U.S. Cl.
CPC ..... *F04C 29/124* (2013.01); *F04C 18/0215* (2013.01); *F04C 29/126* (2013.01)

(58) Field of Classification Search
CPC ... F04C 29/124; F04C 18/0215; F04C 29/126
See application file for complete search history.

(56) References Cited

U.S. PATENT DOCUMENTS 3,303,988 A 2/1967 Weatherhead
3,777,508 A 12/1973 Imabayashi et al.
4,058,988 A 11/1977 Shaw
4,216,661 A 8/1980 Tojo et al.
4,313,314 A 2/1982 Boyanich
(Continued)

FOREIGN PATENT DOCUMENTS

AU 2002301023 B2 6/2005
CN 1137614 A 12/1996
(Continued)

OTHER PUBLICATIONS

Search Report regarding European Patent Application No. 241933761, dated Feb. 10, 2025.
(Continued)

*Primary Examiner* — Mary A Davis
(74) *Attorney, Agent, or Firm* — Harness, Dickey & Pierce, P.L.C.

(57) ABSTRACT

A compressor may a first scroll, a second scroll, and a valve assembly. The second scroll may include a discharge passage. The valve assembly may include a valve housing fixed relative to the second scroll and a valve member movably received in the valve housing. The valve housing may include a plurality of angled apertures that are angled relative to a direction in which the valve member moves between the open and closed positions. The valve member is movable relative to the valve housing and valve retainer between an open position and a closed position. When the valve member is in the open position, fluid is allowed to flow through the discharge passage and the angled apertures in the valve housing. When the valve member is in the closed position, fluid flow through the discharge passage and the angled apertures is restricted.

20 Claims, 10 Drawing Sheets

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,469,126 A 9/1984 Simpson
4,475,360 A 10/1984 Suefuji et al.
4,475,875 A 10/1984 Sugimoto et al.
4,480,965 A 11/1984 Ishizuka
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,893,476 A 1/1990 Bos et al.
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,385,034 A 1/1995 Haselden
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,622,487 A 4/1997 Fukuhara et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,667,371 A 9/1997 Prenger et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,791,328 A 8/1998 Alexander
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,056,523 A 5/2000 Won et al.
6,065,948 A 5/2000 Brown
6,068,459 A 5/2000 Clarke et al.
6,086,335 A 7/2000 Bass et al.
6,093,005 A 7/2000 Nakamura
6,095,764 A 8/2000 Shibamoto et al.
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,132,191 A 10/2000 Hugenroth et al.
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,217,302 B1 4/2001 Sun et al.
6,224,356 B1 5/2001 Dewar et al.
6,227,830 B1 5/2001 Fields et al.
6,231,316 B1 5/2001 Wakisaka et al.
6,257,840 B1 7/2001 Ignatiev et al.
6,264,444 B1 7/2001 Nakane et al.
6,264,452 B1 7/2001 Sun et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,327,871 B1 12/2001 Rafalovich
6,338,912 B1 1/2002 Ban et al.
6,350,111 B1 2/2002 Perevozchikov et al.
6,361,890 B1 3/2002 Ban et al.
6,379,123 B1 4/2002 Makino et al.

(56) References Cited

U.S. PATENT DOCUMENTS 6,379,133 B1 4/2002 Hahn et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,422,842 B2 7/2002 Sheridan et al.
6,428,286 B1 8/2002 Shimizu et al.
6,454,551 B2 9/2002 Kuroki et al.
6,457,948 B1 10/2002 Pham
6,457,952 B1 10/2002 Haller et al.
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,619,936 B2 9/2003 Perevozchikov
6,672,845 B1 1/2004 Kim et al.
6,679,683 B2 1/2004 Seibel et al.
6,705,848 B2 3/2004 Scancarello
6,715,999 B2 4/2004 Ancel et al.
6,745,584 B2 6/2004 Pham et al.
6,746,223 B2 6/2004 Manole
6,749,412 B2 6/2004 Narasipura et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,848,893 B2 * 2/2005 Tarng ..... F04C 29/126 417/559
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,112,046 B2 9/2006 Kammhoff et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
7,429,167 B2 9/2008 Bonear et al.
RE40,554 E 10/2008 Bass et al.
7,484,374 B2 2/2009 Pham et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,827,809 B2 11/2010 Pham et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,020,402 B2 9/2011 Pham et al.
8,025,492 B2 9/2011 Seibel et al.
8,079,229 B2 12/2011 Lifson et al.
8,162,622 B2 4/2012 Shoulders
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,328,543 B2 12/2012 Wilson
8,393,882 B2 3/2013 Ignatiev et al.
8,424,326 B2 4/2013 Mitra et al.
8,505,331 B2 8/2013 Pham et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,068,765 B2 6/2015 Huff
9,080,446 B2 7/2015 Heusler et al.
9,127,677 B2 9/2015 Doepker
9,145,891 B2 9/2015 Kim et al.
9,169,839 B2 10/2015 Ishizono et al.
9,194,395 B2 11/2015 Ginies et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,360,011 B2 6/2016 Perevozchikov et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,605,677 B2 3/2017 Heidecker et al.
9,612,042 B2 4/2017 Sjoholm et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,797,400 B2 10/2017 Yun et al.
9,850,903 B2 12/2017 Perevozchikov
9,869,315 B2 1/2018 Jang et al.
9,879,674 B2 1/2018 Akei et al.
9,885,347 B2 2/2018 Lachey et al.
9,920,759 B2 3/2018 Sung et al.
9,926,932 B2 3/2018 Perevozchikov et al.
9,989,057 B2 6/2018 Lochner et al.
10,047,985 B2 8/2018 Kopko
10,066,622 B2 9/2018 Pax et al.
10,087,936 B2 10/2018 Pax et al.
10,088,202 B2 10/2018 Huff et al.
10,094,380 B2 10/2018 Doepker et al.
10,323,639 B2 6/2019 Doepker et al.
10,428,818 B2 10/2019 Jin et al.
10,535,245 B2 1/2020 Callemo et al.

(56) References Cited

U.S. PATENT DOCUMENTS

| | | | |
|---|---|---|---|
| 10,563,891 | B2 | 2/2020 | Smerud et al. |
| 10,724,523 | B2 | 7/2020 | Wu et al. |
| 10,815,999 | B2 | 10/2020 | Jeong |
| 10,907,633 | B2 | 2/2021 | Doepker et al. |
| 10,954,940 | B2 | 3/2021 | Akei et al. |
| 10,974,317 | B2 | 4/2021 | Ruxanda et al. |
| 11,209,000 | B2 | 12/2021 | Moore et al. |
| 11,231,034 | B2 | 1/2022 | Funakoshi et al. |
| 11,300,329 | B2 | 4/2022 | Yan et al. |
| 11,371,504 | B2 | 6/2022 | Ma et al. |
| 11,378,290 | B2 | 7/2022 | Locke et al. |
| 11,493,040 | B2 | 11/2022 | Zou et al. |
| 11,592,215 | B2 | 2/2023 | Brown |
| 11,768,018 | B2 | 9/2023 | Desmarais |
| 11,846,287 | B1 | 12/2023 | Gehret et al. |
| 11,846,454 | B2 | 12/2023 | Temple |
| 11,905,953 | B2 | 2/2024 | Liang et al. |
| 11,959,690 | B2 | 4/2024 | LeRoy |
| 12,031,755 | B2 | 7/2024 | Catano-Montoya |
| 12,173,708 | B1 | 12/2024 | Butler et al. |
| 2001/0010800 | A1 | 8/2001 | Kohsokabe et al. |
| 2002/0039540 | A1 | 4/2002 | Kuroki et al. |
| 2002/0057975 | A1 | 5/2002 | Nakajima et al. |
| 2002/0114720 | A1 | 8/2002 | Itoh et al. |
| 2003/0044296 | A1 | 3/2003 | Chen |
| 2003/0044297 | A1 | 3/2003 | Gennami et al. |
| 2003/0186060 | A1 | 10/2003 | Rao |
| 2003/0228235 | A1 | 12/2003 | Sowa et al. |
| 2004/0126259 | A1 | 7/2004 | Choi et al. |
| 2004/0136854 | A1 | 7/2004 | Kimura et al. |
| 2004/0146419 | A1 | 7/2004 | Kawaguchi et al. |
| 2004/0170509 | A1 | 9/2004 | Wehrenberg et al. |
| 2004/0184932 | A1 | 9/2004 | Lifson |
| 2004/0197204 | A1 | 10/2004 | Yamanouchi et al. |
| 2004/0206110 | A1 | 10/2004 | Lifson et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0140232 | A1 | 6/2005 | Lee et al. |
| 2005/0142017 | A1 | 6/2005 | Liang et al. |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0138879 | A1 | 6/2006 | Kusase et al. |
| 2006/0198748 | A1 | 9/2006 | Grassbaugh et al. |
| 2006/0228243 | A1 | 10/2006 | Sun et al. |
| 2006/0233657 | A1 | 10/2006 | Bonear et al. |
| 2007/0003666 | A1 | 1/2007 | Gutknecht et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2007/0148026 | A1 | 6/2007 | Higashi |
| 2007/0194261 | A1 | 8/2007 | Kato et al. |
| 2008/0034772 | A1 | 2/2008 | Chumley et al. |
| 2008/0115357 | A1 | 5/2008 | Li et al. |
| 2008/0138227 | A1 | 6/2008 | Knapke |
| 2008/0159892 | A1 | 7/2008 | Huang et al. |
| 2008/0159893 | A1 | 7/2008 | Caillat |
| 2008/0184733 | A1 | 8/2008 | Skinner |
| 2008/0196445 | A1 | 8/2008 | Lifson et al. |
| 2008/0197206 | A1 | 8/2008 | Murakami et al. |
| 2008/0223057 | A1 | 9/2008 | Lifson et al. |
| 2008/0226483 | A1 | 9/2008 | Iwanami et al. |
| 2008/0286118 | A1 | 11/2008 | Gu et al. |
| 2008/0305270 | A1 | 12/2008 | Uhlianuk et al. |
| 2009/0013701 | A1 | 1/2009 | Lifson et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0191080 | A1 | 7/2009 | Ignatiev et al. |
| 2009/0205345 | A1 | 8/2009 | Narayanamurthy et al. |
| 2009/0288430 | A1 | 11/2009 | Anderson |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0209278 | A1 | 8/2010 | Tarao et al. |
| 2010/0212311 | A1 | 8/2010 | McQuary et al. |
| 2010/0212352 | A1 | 8/2010 | Kim et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0052437 | A1 | 3/2011 | Titsuka et al. |
| 2011/0135509 | A1 | 6/2011 | Fields et al. |
| 2011/0154848 | A1 | 6/2011 | Jin |
| 2011/0174014 | A1 | 7/2011 | Scarcella et al. |
| 2011/0206548 | A1 | 8/2011 | Doepker |
| 2011/0243777 | A1 | 10/2011 | Ito et al. |
| 2011/0250085 | A1 | 10/2011 | Stover et al. |
| 2011/0293456 | A1 | 12/2011 | Seibel et al. |
| 2012/0009076 | A1 | 1/2012 | Kim et al. |
| 2012/0067070 | A1 | 3/2012 | Albertson |
| 2012/0107163 | A1 | 5/2012 | Monnier et al. |
| 2012/0148433 | A1 | 6/2012 | Liang et al. |
| 2012/0183422 | A1 | 7/2012 | Bahmata |
| 2012/0195781 | A1 | 8/2012 | Stover et al. |
| 2013/0061627 | A1 | 3/2013 | Neumeister et al. |
| 2013/0078128 | A1 | 3/2013 | Akei |
| 2013/0089448 | A1 | 4/2013 | Ginies et al. |
| 2013/0094987 | A1 | 4/2013 | Yamashita et al. |
| 2013/0098071 | A1 | 4/2013 | Means |
| 2013/0121857 | A1 | 5/2013 | Liang et al. |
| 2013/0177465 | A1 | 7/2013 | Clendenin et al. |
| 2013/0195707 | A1 | 8/2013 | Kozuma et al. |
| 2013/0302198 | A1 | 11/2013 | Ginies et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2014/0219846 | A1 | 8/2014 | Ignatiev et al. |
| 2015/0037184 | A1 | 2/2015 | Rood et al. |
| 2015/0086404 | A1 | 3/2015 | Kiem et al. |
| 2015/0192121 | A1 | 7/2015 | Sung et al. |
| 2015/0233375 | A1 | 8/2015 | Kim et al. |
| 2015/0275898 | A1 | 10/2015 | Ahire et al. |
| 2015/0300353 | A1 | 10/2015 | Utpat et al. |
| 2015/0330386 | A1 | 11/2015 | Doepker |
| 2015/0345493 | A1 | 12/2015 | Lochner et al. |
| 2015/0354719 | A1 | 12/2015 | van Beek et al. |
| 2016/0025093 | A1 | 1/2016 | Doepker |
| 2016/0025094 | A1 | 1/2016 | Ignatiev et al. |
| 2016/0032924 | A1 | 2/2016 | Stover |
| 2016/0047380 | A1 | 2/2016 | Kim et al. |
| 2016/0053755 | A1 | 2/2016 | Taguchi |
| 2016/0053759 | A1 | 2/2016 | Choi et al. |
| 2016/0076543 | A1 | 3/2016 | Akei et al. |
| 2016/0115954 | A1 | 4/2016 | Doepker et al. |
| 2016/0138732 | A1 | 5/2016 | Lively et al. |
| 2016/0138879 | A1 | 5/2016 | Matsukado et al. |
| 2016/0178253 | A1 | 6/2016 | Katoh et al. |
| 2016/0201673 | A1 | 7/2016 | Perevozchikov et al. |
| 2016/0208803 | A1 | 7/2016 | Uekawa et al. |
| 2016/0272047 | A1 | 9/2016 | Gan |
| 2017/0002817 | A1 | 1/2017 | Stover |
| 2017/0002818 | A1 | 1/2017 | Stover |
| 2017/0030354 | A1 | 2/2017 | Stover |
| 2017/0097108 | A1 | 4/2017 | Huff |
| 2017/0241417 | A1 | 8/2017 | Jin et al. |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2017/0342978 | A1 | 11/2017 | Doepker |
| 2017/0342983 | A1 | 11/2017 | Jin et al. |

(56) References Cited

U.S. PATENT DOCUMENTS

| | | | |
|---|---|---|---|
| 2017/0342984 | A1 | 11/2017 | Jin et al. |
| 2018/0023570 | A1 | 1/2018 | Huang et al. |
| 2018/0038369 | A1 | 2/2018 | Doepker et al. |
| 2018/0038370 | A1 | 2/2018 | Doepker et al. |
| 2018/0066656 | A1 | 3/2018 | Perevozchikov et al. |
| 2018/0066657 | A1 | 3/2018 | Perevozchikov et al. |
| 2018/0135625 | A1 | 5/2018 | Naganuma et al. |
| 2018/0149155 | A1 | 5/2018 | Akei et al. |
| 2018/0216618 | A1 | 8/2018 | Jeong |
| 2018/0223823 | A1 | 8/2018 | Ignatiev et al. |
| 2019/0040861 | A1 | 2/2019 | Doepker et al. |
| 2019/0041107 | A1 | 2/2019 | Piscopo et al. |
| 2019/0101120 | A1 | 4/2019 | Perevozchikov et al. |
| 2019/0162185 | A1 | 5/2019 | Mizushima et al. |
| 2019/0186491 | A1 | 6/2019 | Perevozchikov et al. |
| 2019/0203709 | A1 | 7/2019 | Her et al. |
| 2019/0210425 | A1 | 7/2019 | Azzouz et al. |
| 2019/0277288 | A1 | 9/2019 | Flanigan et al. |
| 2019/0353164 | A1 | 11/2019 | Berning et al. |
| 2020/0057458 | A1 | 2/2020 | Taguchi |
| 2020/0291943 | A1 | 9/2020 | McBean et al. |
| 2020/0370808 | A1 | 11/2020 | Feng et al. |
| 2021/0018234 | A1 | 1/2021 | Lingrey et al. |
| 2021/0222788 | A1 | 7/2021 | Willers et al. |
| 2021/0262470 | A1 | 8/2021 | Wei et al. |
| 2022/0065504 | A1 | 3/2022 | Zou |
| 2022/0235774 | A1 | 7/2022 | Cui et al. |
| 2023/0366599 | A1 | 11/2023 | Yu |
| 2023/0392835 | A1 | 12/2023 | Butler et al. |
| 2023/0400022 | A1 | 12/2023 | Jo et al. |
| 2024/0035717 | A1 | 2/2024 | Zou et al. |
| 2024/0247819 | A1 | 7/2024 | Pedretti |

FOREIGN PATENT DOCUMENTS

| | | | |
|---|---|---|---|
| CN | 1158944 | A | 9/1997 |
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 207795587 | U | 8/2018 |
| CN | 209621603 | U | 11/2019 |
| CN | 209654225 | U | 11/2019 |
| CN | 209781195 | U | 12/2019 |
| CN | 116292280 | A | 6/2023 |
| DE | 3917656 | C2 | 11/1995 |
| DE | 102011001394 | A1 | 9/2012 |
| EP | 0256445 | A2 | 2/1988 |
| EP | 0747598 | A2 | 12/1996 |
| EP | 0822335 | A2 | 2/1998 |
| EP | 1067289 | A2 | 1/2001 |
| EP | 1081384 | A2 | 3/2001 |
| EP | 1087142 | A2 | 3/2001 |
| EP | 1182353 | A1 | 2/2002 |
| EP | 1 241 417 | A1 | 9/2002 |
| EP | 0972942 | B1 | 8/2003 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| EP | 3961123 | A1 | 3/2022 |
| FR | 2764347 | A1 | 12/1998 |
| GB | 747832 | A | 4/1956 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 10-2001-0009403 | A | 2/2001 |

(56) References Cited

FOREIGN PATENT DOCUMENTS

| | | | |
|---|---|---|---|
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130011864 | A | 1/2013 |
| KR | 20130094646 | A | 8/2013 |
| KR | 20140114212 | A | 9/2014 |
| KR | 10-2018-0094219 | A | 8/2018 |
| KR | 101917697 | B1 | 11/2018 |
| WO | 9515025 | A1 | 6/1995 |
| WO | 0073659 | A1 | 12/2000 |
| WO | 2007046810 | A2 | 4/2007 |
| WO | 2008060525 | A1 | 5/2008 |
| WO | 2009017741 | A1 | 2/2009 |
| WO | 2009155099 | A2 | 12/2009 |
| WO | 2010118140 | A2 | 10/2010 |
| WO | 2011106422 | A2 | 9/2011 |
| WO | 2012114455 | A1 | 8/2012 |
| WO | 2015187816 | A1 | 12/2015 |
| WO | 2017071641 | A1 | 5/2017 |
| WO | 2019128793 | A1 | 7/2019 |
| WO | 2019165254 | A1 | 8/2019 |
| WO | 2019222535 | A1 | 11/2019 |
| WO | 2021007528 | A1 | 1/2021 |

OTHER PUBLICATIONS

Search Report regarding European Patent Application No. 242194223, dated May 30, 2025.
Non-Final Office Action for U.S. Appl. No. 18/115,355 dated Jul. 18, 2023.
International Search Report Regarding Application PCT/US2023/015116-WO-POA Dated Sep. 5, 2023.
International Search Report regarding International Application No. PCT/US2011/025921, dated Oct. 7, 2011.
Written Opinion of the International Search Authority regarding International Application No. PCT/US2011/025921, dated Oct. 7, 2011.
Written Opinion of the International Searching Authority regarding International Application No. PCT/US2010/030248, dated Nov. 26, 2010.
International Search Report regarding International Application No. PCT/US2010/030248, dated Nov. 26, 2010.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding U.S. Appl. No. 11/645,288, dated Nov. 30, 2009.
Search Report regarding European Patent Application No. 07254962.9, dated Mar. 12, 2008.
Office Action regarding Chinese Patent Application No. 200710160038.5, dated Jul. 8, 2010. Translation provided by Unitalen Attorneys At Law.
Office Action regarding Chinese Patent Application No. 200710160038.5, dated Jan. 31, 2012. Translation provided by Unitalen Attorneys At Law.
Office Action regarding Chinese Patent Application No. 201080020243.1, dated Nov. 5, 2013. Translation provided by Unitalen Attorneys At Law.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
Office Action regarding Chinese Patent Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Notice of Allowance regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.
Office Action regarding Chinese Patent Application No. 201380059666.8, dated Apr. 5, 2016. Translation provided by Unitalen Attorneys At Law.
Office Action regarding Chinese Patent Application No. 201380062614.6, dated Apr. 5, 2016. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.

(56) References Cited

OTHER PUBLICATIONS

Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Notice of Allowance regarding U.S. Appl. No. 18/541,828 dated Aug. 12, 2024.
Notice of Allowance regarding U.S. Appl. No. 18/533,121 dated Aug. 14, 2024.
Final Office Action regarding U.S. Appl. No. 18/394,474 dated Aug. 28, 2024.
Non-Final Office Action regarding U.S. Appl. No. 17/830,026 dated Jul. 9, 2024.
Notice of Allowance regarding U.S. Appl. No. 18/381,884 dated Sep. 4, 2024.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys At Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/651,471, dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Restriction Requirement regarding U.S. Appl. No. 15/784,458, dated Apr. 5, 2018.
Restriction Requirement regarding U.S. Appl. No. 15/186,092, dated Apr. 3, 2018.
Office Action regarding U.S. Appl. No. 15/186,151, dated May 3, 2018.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Restriction Requirement regarding U.S. Appl. No. 15/587,735, dated Jul. 23, 2018.
Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.
Office Action regarding Chinese Patent Application No. 201610499158.7, dated Aug. 1, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding U.S. Appl. No. 11/522,250, dated Aug. 1, 2007.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
Office Action regarding Chinese Patent Application No. 201010224582.3, dated Apr. 17, 2012. Translation provided by Unitalen Attorneys at Law.

(56) References Cited

OTHER PUBLICATIONS

Office Action regarding Indian Patent Application No. 1071/KOL/2007, dated Apr. 27, 2012.
Office Action regarding U.S. Appl. No. 13/036,529, dated Aug. 22, 2012.
International Search Report regarding International Application No. PCT/US2015/042479, dated Oct. 23, 2015.
Written Opinion of the International Searching Authority regarding International Application No. PCT/US2015/042479, dated Oct. 23, 2015.
Restriction Requirement regarding U.S. Appl. No. 14/809,786, dated Aug. 16, 2017.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding U.S. Appl. No. 14/809,786, dated Jan. 11, 2018.
Office Action regarding Chinese Patent Application No. 201580041209.5, dated Jan. 17, 2018. Translation provided by Unitalen Attorneys at Law.
Office Action regarding Chinese Patent Application No. 201710795228.8, dated Sep. 5, 2018. Translation provided by Unitalen Attorneys at Law.
Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Korean Patent Application No. 10-2017-7033995, dated Nov. 29, 2018. Translation provided by Ks Koryo International IP Law Firm.
Office Action regarding Indian Patent Application No. 1306/MUMNP/2015, dated Dec. 31, 2018.
Notice of Allowance regarding U.S. Appl. No. 15/187,225, dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.
Notice of Allowance regarding U.S. Appl. No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.
Notice of Allowance regarding U.S. Appl. No. 15/187,225, dated May 2, 2019.
Notice of Allowance regarding U.S. Appl. No. 15/186,092, dated Apr. 19, 2019.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding U.S. Appl. No. 15/692,844, dated Sep. 20, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151, dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.
Office Action regarding European Patent Application No. 11747996.4, dated Jan. 14, 2020.
Office Action regarding Indian Patent Application No. 2043/MUMNP/2011, dated Nov. 27, 2019.
Office Action regarding Chinese Patent Application No. 201811541653.5, dated Jan. 10, 2020. Translation provided by Unitalen Attorneys at Law.
Toyama, T.; Nishikawa, Y.; Yoshida, Y.; Hiodoshi, S.; and Shibamoto, Y., "Reduction Of Noise And Over-Compression Loss By Scroll Compressor With Modified Discharge Check Valve" (2002). International Compressor Engineering Conference. Paper 1587.
Yanagisawa, M.; Uematsu, T.; Hiodoshi, S.; Saito, M.; and Era, S., "Noise Reduction Technology For Inverter Controlled Scroll Compressors" (2002). International Compressor Engineering Conference. Paper 1578.
Lee, J. K.; Lee, S. J.; Lee, D. S.; Lee, B. C.; and Lee, U. S., "Identification and Reduction of Noise in a Scroll Compressor" (2000). International Compressor Engineering Conference. Paper 1496.
Non-Final Office Action regarding U.S. Appl. No. 18/394,474 dated Apr. 11, 2024.
International Search Report and Written Opinion regarding Application No. PCT/US2023/086010 dated Apr. 24, 2024.
Final Office Action regarding U.S. Appl. No. 17/835,048 dated May 3, 2024.
Non-Final Office Action regarding U.S. Appl. No. 18/381,884 dated May 10, 2024.
Notice of Allowance regarding U.S. Appl. No. 15/692,844, dated Feb. 20, 2020.
Office Action regarding Chinese Patent Application No. 201811168307.7, dated Mar. 27, 2020. Translation provided by Unitalen Attorneys at Law.

(56) References Cited

OTHER PUBLICATIONS

Office Action regarding European Patent Application No. 13859308.2, dated Mar. 4, 2020.
Office Action regarding Korean Patent Application No. 10-2018-0159231, dated Apr. 7, 2020. Translation provided by Ks Koryo International IP Law Firm.
Notice of Allowance regarding U.S. Appl. No. 15/682,599, dated Apr. 22, 2020.
Office Action regarding Chinese Patent Application No. 201780055443.2, dated Apr. 14, 2020. Translation provided by Unitalen Attorneys At Law.
Notice of Allowance regarding U.S. Appl. No. 15/831,423, dated May 20, 2020.
Restriction Requirement regarding U.S. Appl. No. 16/147,920, dated Jun. 25, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Office Action regarding U.S. Appl. No. 16/177,902, dated Jul. 23, 2020.
Office Action regarding U.S. Appl. No. 15/881,016, dated Jul. 21, 2020.
Office Action regarding Chinese Patent Application No. 201811480347.5, dated Jul. 21, 2020. Translation provided by Unitalen Attorneys at Law.
Notice of Allowance regarding U.S. Appl. No. 16/154,406, dated Oct. 2, 2020.
Office Action regarding U.S. Appl. No. 16/154,844, dated Oct. 5, 2020.
Office Action regarding U.S. Appl. No. 16/147,920, dated Sep. 25, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Office Action mailed Jan. 19, 2023, in U.S. Appl. No. 17/196,119.
Office Action mailed Mar. 9, 2023, in U.S. Appl. No. 17/835,048.
Notice of Allowance regarding U.S. Appl. No. 17/196,119 dated Apr. 26, 2023.
Non-Final Office Action regarding U.S. Appl. No. 17/886,047 dated May 17, 2023.
Non-Final Office Action regarding U.S. Appl. No. 17/980,798 dated May 24, 2023.
Office Action regarding Chinese Patent Application No. 2022109807542, dated May 15, 2023. Translation provided by Unitalen Attorneys at Law.
Office Action regarding European Patent Application No. 198040792, dated Jun. 13, 2023.
Notice of Allowance regarding U.S. Appl. No. 17/866,047 dated Aug. 18, 2023.
Notice of Allowance regarding U.S. Appl. No. 17/980,798 dated Sep. 20, 2023.
Final Office Action regarding U.S. Appl. No. 17/835,048 dated Aug. 10, 2023.
International Search Report and Written Opinion regarding App. No. PCT/US2023/023852 dated Sep. 20, 2023.
International Search Report and Written Opinion in corresponding Application No. PCT/US2023/029860 dated Nov. 21, 2023.
International Search Report and Written Opinion in corresponding Application No. PCT/US2022/033029 dated Dec. 6, 2022.
International Search Report and Written Opinion regarding Application No. PCT/US2023/029860 dated Nov. 21, 2023.
Liegeois, Olivier and Winandy, Eric, "Scroll Compressors for Dedicated Heat Pumps: Development and Performance Comparison" (2008). International Compressor Engineering Conference. Paper 1906.
Itoh, T.; Fujitani, M.; and Takeda, K., "Investigation of Discharge Flow Pulsation in Scroll Compressors" (1994). International Compressor Engineering Conference. Paper 1056.
Final Office Action regarding U.S. Appl. No. 18/394,474 dated Nov. 21, 2023.
Partial Search Report regarding European Patent Application No. 228053047, dated Feb. 17, 2025.
Search Report regarding European Patent Application No. 228053047, dated May 9, 2025.
363 Adjustable Angle Base Flange, Kee Klamp, Simplified Building 2025.

* cited by examiner

COMPRESSOR HAVING SHUTDOWN VALVE ASSEMBLY

CROSS-REFERENCE TO RELATED APPLICATIONS

This application claims the benefit and priority of Indian Patent Application No. 202321053150, filed Aug. 8, 2023. The entire disclosure of the above application is incorporated herein by reference.

FIELD

The present disclosure relates to a compressor having a shutdown valve assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure and is not a comprehensive disclosure of its full scope or all of its features.

In one aspect, the present disclosure provides a compressor that includes a first scroll, a second scroll, and a valve assembly (e.g., a shutdown valve assembly). The first scroll includes a first end plate and a first spiral wrap extending from the first end plate. The second scroll includes a second end plate and a second spiral wrap extending from the second end plate and meshing with the first spiral wrap to define fluid pockets therebetween. The second end plate may include a discharge passage and a discharge recess. The valve assembly may be disposed at least partially within the discharge recess and may include a valve housing, a valve retainer, and valve member. The valve housing may be fixed relative to the second scroll. The valve retainer may be fixed relative to the valve housing. The valve member may be movably received in the valve housing. The valve member is movable relative to the valve housing and valve retainer between an open position and a closed position. When the valve member is in the open position, fluid is allowed to flow through the discharge passage and the valve assembly. When the valve member is in the closed position, fluid flow through the discharge passage and the valve assembly is restricted. The valve housing may include a plurality of angled apertures that are angled relative to a direction in which the valve member moves between the open and closed positions.

In some configurations of the compressor of the above paragraph, the angled apertures in the valve housing extend between an inner diametrical surface of the valve housing and an outer diametrical surface of the valve housing.

In some configurations of the compressor of either or both of the above paragraphs, the openings of the angled apertures at the inner diametrical surface of the valve housing are disposed between the valve member and the discharge passage when the valve member is in the open position.

In some configurations of the compressor of any one or more of the above paragraphs, a radially outer surface of the valve member covers the openings of the angled apertures when the valve member is in the closed position.

In some configurations of the compressor of any one or more of the above paragraphs, the radially outer surface of the valve member slidingly contacts the inner diametrical surface of the valve housing as the valve member moves between the open and closed positions.

In some configurations of the compressor of any one or more of the above paragraphs, the valve housing includes a gas-return aperture.

In some configurations of the compressor of any one or more of the above paragraphs, the gas-return aperture and the angled apertures are in fluid communication with a discharge-pressure region (e.g., a discharge chamber) of the compressor.

In some configurations of the compressor of any one or more of the above paragraphs, the valve housing includes a projection that extends into an interior volume of the valve housing and includes an axial end surface that defines a stop for the valve member in the open position.

In some configurations of the compressor of any one or more of the above paragraphs, the gas-return aperture extends through the axial end surface of the projection.

In some configurations of the compressor of any one or more of the above paragraphs, the valve retainer defines a valve seat that contacts the valve member when the valve member is in the closed position.

In some configurations of the compressor of any one or more of the above paragraphs, the valve seat defines an opening that is in fluid communication with the discharge passage.

In some configurations of the compressor of any one or more of the above paragraphs, the valve housing includes a base portion and a body portion.

In some configurations of the compressor of any one or more of the above paragraphs, the base portion has a larger diameter than the body portion and fixedly engages an inner diametrical surface of a hub of the second scroll.

In some configurations of the compressor of any one or more of the above paragraphs, the angled apertures are disposed in the body portion.

In some configurations of the compressor of any one or more of the above paragraphs, the body portion and the inner diametrical surface of the hub cooperate to define an annular gas flow path that is in fluid communication with the angled apertures and the discharge passage when the valve member is in the open position.

In another aspect, the present disclosure provides a compressor that includes a first scroll, a second scroll, and a valve assembly (e.g., a shutdown valve assembly). The first scroll includes a first end plate and a first spiral wrap extending from the first end plate. The second scroll includes a second end plate and a second spiral wrap extending from the second end plate and meshing with the first spiral wrap to define fluid pockets therebetween. The second end plate may include a discharge passage. The valve assembly may include a valve housing fixed relative to the second scroll, a valve retainer fixed relative to the valve housing, and a valve member movably received in the valve housing. The valve housing may include a plurality of angled apertures that are angled relative to a direction in which the valve member moves between the open and closed positions. The valve member is movable relative to the valve housing and valve retainer between an open position and a closed position. When the valve member is in the open position, fluid is allowed to flow through the discharge passage and through the angled apertures in the valve housing. When the valve member is in the closed position, fluid flow through the discharge passage and the angled apertures is restricted.

In some configurations of the compressor of the above paragraph, the angled apertures in the valve housing extend between an inner diametrical surface of the valve housing and an outer diametrical surface of the valve housing.

In some configurations of the compressor of either or both of the above paragraphs, the openings of the angled apertures at the inner diametrical surface of the valve housing are disposed between the valve member and the discharge passage when the valve member is in the open position.

In some configurations of the compressor of any one or more of the above paragraphs, a radially outer surface of the valve member covers the openings of the angled apertures when the valve member is in the closed position.

In some configurations of the compressor of any one or more of the above paragraphs, the radially outer surface of the valve member slidingly contacts the inner diametrical surface of the valve housing as the valve member moves between the open and closed positions.

In some configurations of the compressor of any one or more of the above paragraphs, the valve housing includes a gas-return aperture.

In some configurations of the compressor of any one or more of the above paragraphs, the gas-return aperture and the angled apertures are in fluid communication with a discharge-pressure region (e.g., a discharge chamber) of the compressor.

In some configurations of the compressor of any one or more of the above paragraphs, the valve housing includes a projection that extends into an interior volume of the valve housing and includes an axial end surface that defines a stop for the valve member in the open position.

In some configurations of the compressor of any one or more of the above paragraphs, the gas-return aperture extends through the axial end surface of the projection.

In some configurations of the compressor of any one or more of the above paragraphs, the valve retainer defines a valve seat that contacts the valve member when the valve member is in the closed position.

In some configurations of the compressor of any one or more of the above paragraphs, the valve seat defines an opening that is in fluid communication with the discharge passage.

In some configurations of the compressor of any one or more of the above paragraphs, the valve housing includes a base portion and a body portion.

In some configurations of the compressor of any one or more of the above paragraphs, the base portion has a larger diameter than the body portion and fixedly engages an inner diametrical surface of a hub of the second scroll.

In some configurations of the compressor of any one or more of the above paragraphs, the angled apertures are disposed in the body portion.

In some configurations of the compressor of any one or more of the above paragraphs, the body portion and the inner diametrical surface of the hub cooperate to define an annular gas flow path that is in fluid communication with the angled apertures and the discharge passage when the valve member is in the open position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
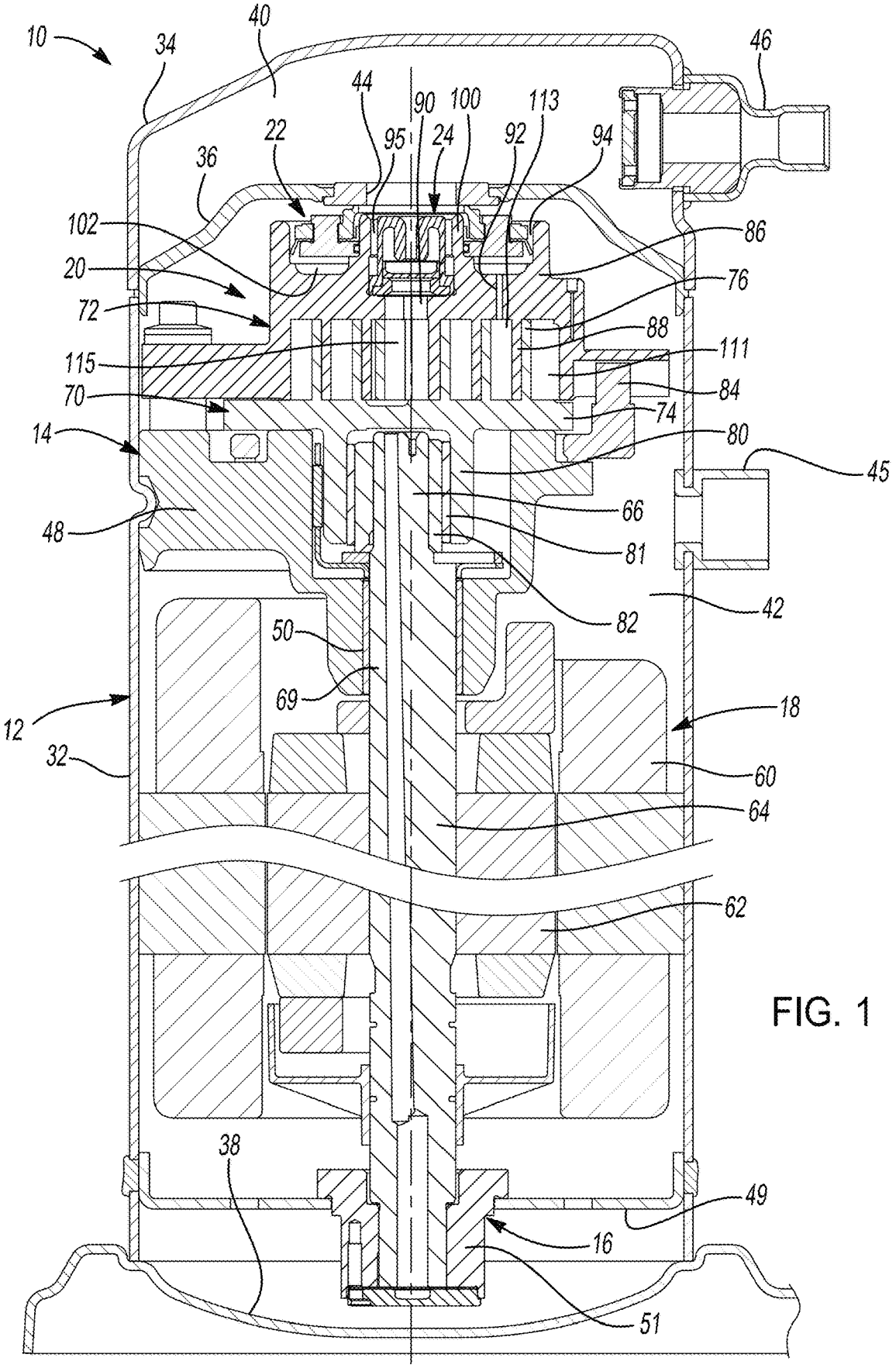
FIG. 1 is a cross-sectional view of a compressor having a shutdown valve assembly according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided that may include a hermetic shell assembly 12, first and second bearing-housing assemblies 14, 16, a motor assembly 18, a compression mechanism 20, a floating seal assembly 22, and a shutdown valve assembly 24.

The shell assembly 12 may form a compressor housing and may include a cylindrical shell 32, an end cap 34 at an upper end thereof, a transversely extending partition 36, and a base 38 at a lower end thereof. The end cap 34 and the partition 36 may define a discharge chamber 40. The partition 36 may separate the discharge chamber 40 from a suction chamber 42. A discharge passage 44 may extend through the partition 36 to provide communication between the compression mechanism 20 and the discharge chamber 40. A suction fitting 45 may provide fluid communication between the suction chamber 42 and a low side of a climate-control system in which the compressor 10 is installed. A discharge fitting 46 may provide fluid communication between the discharge chamber 40 and a high side of the climate-control system in which the compressor 10 is installed.

The first bearing-housing assembly 14 may be fixed relative to the shell 32 and may include a first bearing-housing 48 and a first bearing 50. The first bearing-housing 48 may axially support the compression mechanism 20 and may house the first bearing 50 therein. The first bearing-housing 48 may include a plurality of radially extending arms engaging the shell 32. The second bearing-housing assembly 16 may be fixed relative to the shell 32 and may include a second bearing-housing 49 and a second bearing 51.

The motor assembly 18 may include a motor stator 60, a rotor 62, and a driveshaft 64. The motor stator 60 may be press fit into the shell 32. The rotor 62 may be press fit on the driveshaft 64 and may transmit rotational power to the driveshaft 64. The driveshaft 64 may be rotatably supported by the first and second bearing-housing assemblies 14, 16. The driveshaft 64 may include an eccentric crank pin 66 having a flat surface thereon. A main body 69 of the driveshaft 64 may be rotatably supported by the first and second bearings 50, 51 and the first and second bearing-housing assemblies 48, 49.

The compression mechanism 20 may include an orbiting scroll 70 and a non-orbiting scroll 72. The orbiting scroll 70 may include an end plate 74 and a spiral wrap 76 extending therefrom. A cylindrical hub 80 may project downwardly from the end plate 74 and may include a drive bushing 82 disposed therein. A drive bearing 81 may also be disposed within the hub 80 and may surround the drive bushing 82 and the crank pin 66 (i.e., the drive bearing 81 may be disposed radially between the hub 80 and the drive bushing 82). The drive bushing 82 may include an inner bore in which the crank pin 66 is drivingly disposed. The crank pin flat may drivingly engage a flat surface in a portion of the inner bore to provide a radially compliant driving arrangement. An Oldham coupling 84 may be engaged with the orbiting scroll 70 and the first bearing housing 48 to prevent relative rotation between the orbiting and non-orbiting scrolls 70, 72. Alternatively, the Oldham coupling 84 may be engaged with the orbiting and non-orbiting scrolls 70, 72 to prevent relative rotation between the orbiting and non-orbiting scrolls 70, 72.

The non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets (i.e., compression pockets). The fluid pockets defined by the spiral wraps 76, 88 may decrease in volume as they move from a radially outer position 111 (at a suction pressure) to a radially intermediate position 113 (at an intermediate pressure) to a radially inner position 115 (at a discharge pressure) throughout a compression cycle of the compression mechanism 20.

The end plate 86 may include a discharge passage 90, an intermediate-pressure passage (or biasing passage) 92, an annular recess 94, and a discharge recess 95. The discharge passage 90 is in communication with one of the fluid pockets at the radially inner position 115 and allows compressed working fluid (at the discharge pressure) to flow through the discharge passage 44 in the partition 36 and into the discharge chamber 40. The shutdown valve assembly 24 may be disposed within the discharge recess 95 to allow fluid flow from the fluid pocket at the radially inner position 115 to the discharge chamber 40 and prevent or restrict fluid flow from the discharge chamber 40 to the fluid pocket at the radially inner position 115.

Figure 2:
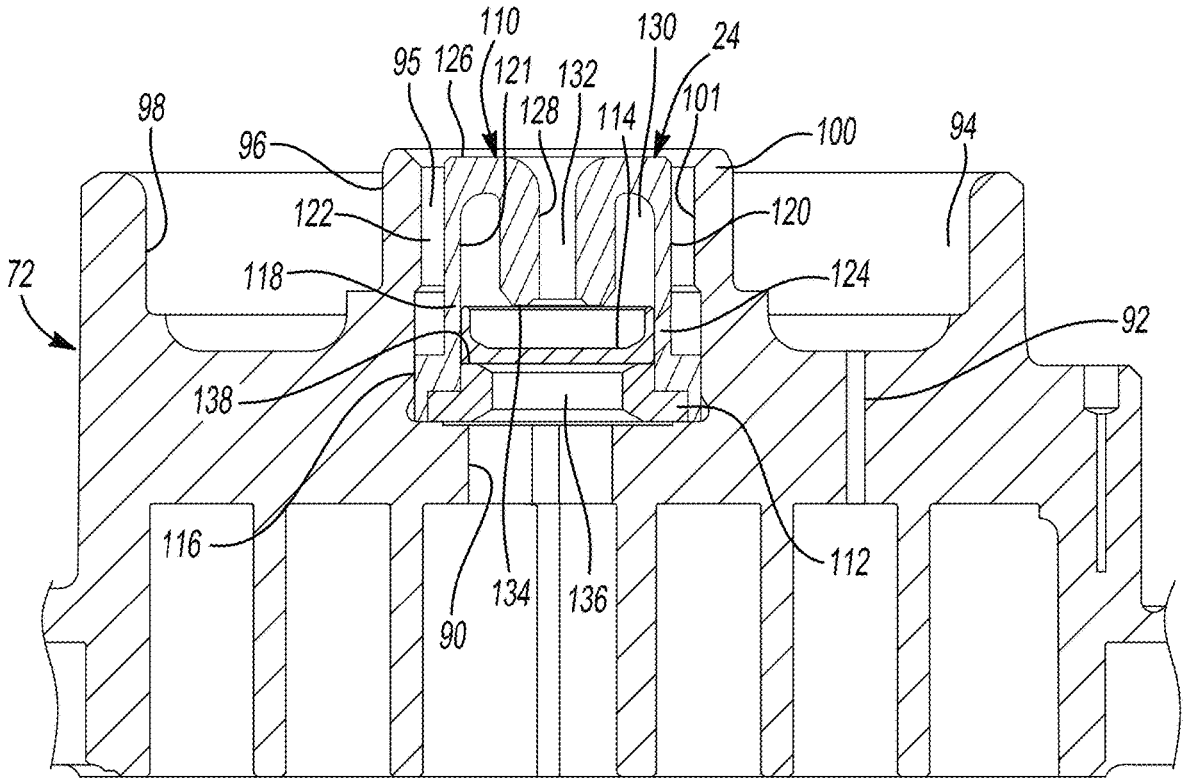
FIG. 2 is a cross-sectional view of a scroll and the shutdown valve assembly of the compressor of FIG. 1 with the shutdown valve assembly in a closed position.
Figure 3:
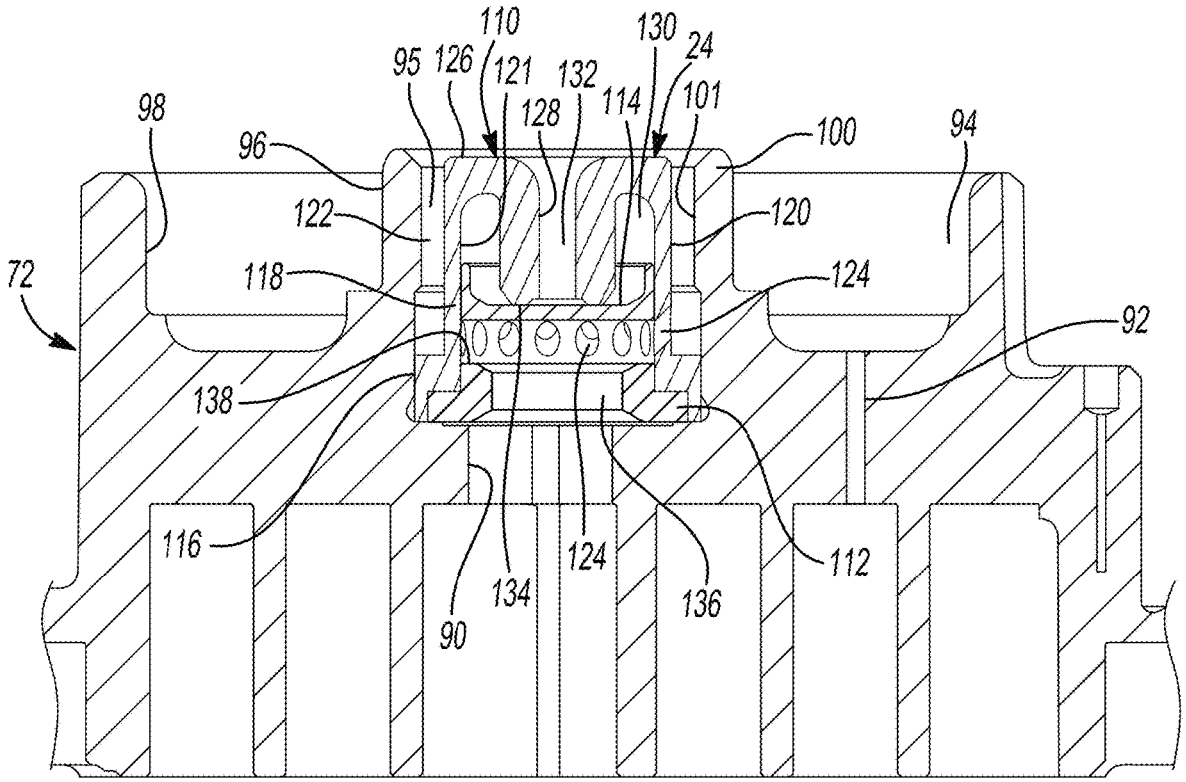
FIG. 3 is a cross-sectional view of the scroll and the shutdown valve assembly of the compressor of FIG. 1 with the shutdown valve assembly in an open position.

The intermediate-pressure passage 92 may provide communication between one of the fluid pockets at the radially intermediate position 113 and the annular recess 94. The annular recess 94 may surround (i.e., encircle) the discharge recess 95. As shown in FIGS. 2 and 3, the annular recess 94 may include a first diametrical surface 96 and a second diametrical surface 98. The first diametrical surface 96 surrounds the discharge recess 95, and the second diametrical surface 98 surrounds the first diametrical surface 96 and the discharge recess 95 (i.e., the second diametrical surface 98 is disposed radially outward relative to the first diametrical surface 96). The end plate 86 may include an annular hub 100 that defines the annular recess 94 and the discharge recess 95. That is, the first diametrical surface 96 is an outer diametrical surface of the annular hub 100, and the discharge recess 95 defines an inner diametrical surface 101 of the annular hub 100. The discharge recess 95 extends through the annular hub 100 and is in communication with the discharge passage 90.

The annular recess 94 may at least partially receive the floating seal assembly 22 and may cooperate with the floating seal assembly 22 to define an annular biasing chamber 102 (FIG. 1) therebetween. The floating seal assembly 22 sealingly engages the first and second diametrical surfaces 96, 98 and the partition 36. In this manner, the floating seal assembly 22 fluidly separates the biasing chamber 102 from the suction chamber 42 and the discharge chamber 40 and fluidly separates the suction chamber 42 from the discharge chamber 40.

The biasing chamber 102 receives intermediate-pressure fluid (e.g., fluid at a pressure less than discharge pressure and higher than suction pressure) from the fluid pocket in the intermediate position 113 through the intermediate-pressure passage 92. A pressure differential between the intermediate-pressure fluid in the biasing chamber 102 and fluid in the suction chamber 42 exerts a net axial biasing force on the non-orbiting scroll 72 urging the non-orbiting scroll 72 toward the orbiting scroll 70 in an axial direction (i.e., in a direction along or parallel to the rotational axis of the driveshaft 64). In this manner, the tips of the spiral wrap 88 of the non-orbiting scroll 72 are urged into sealing engagement with the end plate 74 of the orbiting scroll 70 and the end plate 86 of the non-orbiting scroll 72 is urged into sealing engagement with the tips of the spiral wrap 76 of the orbiting scroll 70.

Figure 4:
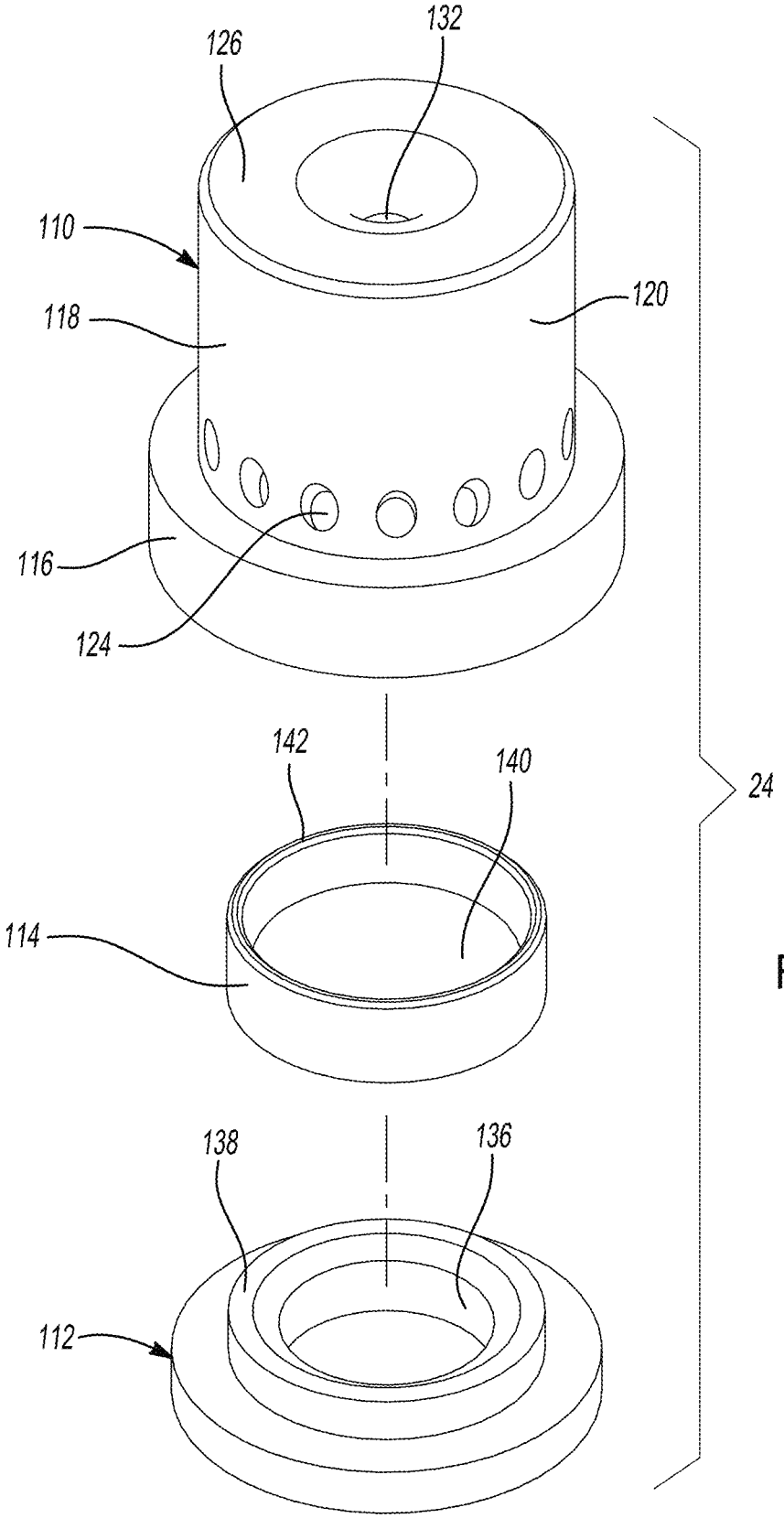
FIG. 4 is an exploded view of the shutdown valve assembly of FIGS. 1-3.

As shown in FIGS. 2-4, the shutdown valve assembly 24 may include a valve housing 110, a retainer 112, and a valve member 114. The valve member 114 is movable relative to the valve housing 110 and the retainer 112 between a closed position (FIG. 2) and an open position (FIG. 3). When the valve member 114 is in the open position, working fluid is allowed to flow through the shutdown valve assembly 24 between the discharge passage 90 and the discharge chamber 40. When the valve member 114 is in the closed position, working fluid is restricted or prevent from flowing through the shutdown valve assembly 24 thereby restricting or preventing fluid flow between the discharge passage 90 and the discharge chamber 40. Pressure differentials between the discharge passage 90 and the discharge chamber 40 move the valve member 114 between the open and closed positions.

The valve housing 110 may be a cylindrical cup-shaped member and may include a base portion 116 and a body portion 118. The base portion 116 may define a first diameter and may fixedly engage (e.g., via threaded engagement, press fit, and/or other means) the inner diametrical surface 101 of the hub 100. The body portion 118 may extend axially upward from an axial end of the base portion 116. The body portion 118 may define a second diameter that is smaller than the first diameter of the base portion 116 such that a radially outermost diametrical surface 120 of the body portion 118 is radially spaced apart from the inner diametrical surface 101 of the hub 100. In this manner, the body portion 118 and the hub 100 define an annular gas flow path 122 disposed radially between the inner diametrical surface 101 of the hub 100 and the outermost diametrical surface 120 of the body portion 118.

The valve housing 110 also includes a plurality of apertures 124 that extend generally radially through body portion 118 to provide fluid communication between the discharge passage 90 and the annular gas flow path 122. The apertures 124 may be angled. For example, a longitudinal axis of each aperture 124 may be disposed at a non-parallel and non-perpendicular angle (e.g., a 45-degree angle, for example) relative to the rotational axis of the driveshaft 64 and relative to a direction in which the valve member 114 moves between the open and closed positions. The apertures 124 may extend through the inner diametrical surface 121 and the outermost diametrical surface 120 of the body portion 118 of the valve housing 110. As shown in FIG. 2, the valve member 114 blocks the apertures 124 of the valve housing 110 when the valve member 114 is in the closed position to prevent fluid communication between the discharge passage 90 and the annular gas flow path 122. As shown in FIG. 3, when the valve member 114 is in the open position, the valve member 114 uncovers the apertures 124 (i.e., the apertures 124 are disposed between the valve member 114 and the discharge passage 90) to allow fluid communication between the discharge passage 90 and the annular gas flow path 122.

An axial end face 126 of the body portion 118 of the valve housing 110 extends radially inward relative to the radially outermost diametrical surface 120 and an inner diametrical surface 121 of the body portion 118. The axial end face 126 is disposed at the opposite axial end of the body portion 118 as the base portion 116 of the valve housing 110. A projection 128 extends from the axial end face 126 in an axial direction into an interior volume 130 of the valve housing 110 (i.e., the interior volume 130 defined by the inner diametrical surface 121). That is, the projection 128 extends from the axial end face 126 toward the discharge passage 90. The projection 128 shown in the figures is cylindrical, but it will be appreciated that the projection 128 could have any other suitable shape such as frustoconical or rectangular prism, for example. A gas-return aperture 132 may extend through the projection 128 and the axial end face 126. An axial end surface 134 of the projection 128 (i.e., the axial end of the projection 128 opposite the axial end face 126) may provide a hard stop for the valve member 114. That is, the axial end surface 134 contacts the valve member 114 in the open position (FIG. 3).

The retainer 112 may be fixed relative to the valve housing 110 and may extend into the interior volume 130 of the valve housing 110. The retainer 112 may be an annular member and includes an opening 136 that provides fluid communication between the discharge passage 90 and the interior volume 130 of the valve housing 110. The retainer 112 may define an annular valve seat 138 that contacts the valve member 114 in the closed position (as shown in FIG. 2). When the valve member 114 is in the open position (FIG. 3), the valve member 114 is spaced apart from the valve seat 138 so that fluid can flow from the discharge passage 90 through the opening 136, through the apertures 124, through the annular gas flow path 122, and into the discharge chamber 40. As shown in FIG. 3, the apertures 124 are disposed axially between the valve seat 138 and the axial end surface 134 of the projection 128, such that the apertures 124 are disposed axially between the valve seat 138 and the valve member 114 when the valve member 114 is in the open position.

The valve member 114 shown in the figures is generally cup-shaped and has a U-shaped cross section. The valve member 114 may include a disc-shaped main body 140 and an annular collar 142 extending axially from the main body 140. One side of the main body 140 contacts the axial end surface 134 of the projection 128 when the valve member 114 is in the open position (FIG. 3), and the opposite side of the main body 140 contacts the valve seat 138 of the retainer 112 when the valve member 114 is in the closed position (FIG. 2). The annular collar 142 of the valve member 114 may be in sliding contact with the inner diametrical surface 121 of the valve housing 110 so that the inner diametrical surface 121 of the valve housing 110 acts as a guide surface as the valve member 114 moves between the open and closed positions. The annular collar 142 may be received in a space radially between the inner diametrical surface 121 and the projection 128 of the valve housing 110 when the valve member 114 is in the open position. In some configurations, the valve member 114 may be entirely disc-shaped and may not include the annular collar 142.

During normal operation of the compressor 10 (e.g., during steady-state operation after startup or during any other operating condition in which working fluid in the fluid pocket at the radially inner position 115 is at a higher pressure than working fluid in the discharge chamber 40), the scrolls 70, 72 may cooperate to compress working fluid (e.g., from the suction pressure to the discharge pressure). Working fluid in the fluid pocket at the radially inner position 115 (e.g., at the discharge pressure) is forced through the discharge passage 90 and through opening 136 in the retainer 112 to force the valve member 114 into the open position (FIG. 3). With the valve member 114 in the open position, the compressed working fluid may flow from the opening 136 through the apertures 124 in the valve housing 110, through the annular gas flow path 122, through the discharge passage 44 of the partition 36, and into the discharge chamber 40. From the discharge chamber 40, the compressed working fluid may flow through the discharge fitting 46 and into the high side of a climate-control system in which the compressor is installed.

When the compressor 10 is shut down or when the compressor 10 is switched to a low-capacity or zero-capacity operating state (or during any other operating condition in which working fluid in the fluid pocket at the radially inner position 115 is at a lower pressure than working fluid in the discharge chamber 40), working fluid from the discharge chamber 40 (or working fluid at the discharge passage 44 of the partition 36) may flow through the gas-return aperture 132 of the valve housing 110 and may force the valve member 114 into the closed position (FIG. 2). As noted above, when the valve member 114 is in the closed position, the apertures 124 in the valve housing 110 are blocked and the opening 136 in the valve retainer 112 is blocked, thereby restricting or preventing fluid flow through the discharge passage 90 (i.e., to reduce or prevent reverse rotation of the orbiting scroll 70).

The shutdown valve assembly 24 described herein has several advantages over prior-art shutdown valves. For example, the structure of the valve housing 110 and valve member 114 provides less surface area over which the valve member 114 and valve housing 110 contact each other. This reduced contact area reduces lateral oil adhesion force between the valve member 114 and the inner diametrical surface 121 of the valve housing 110. Furthermore, the relatively small contact area between the valve member 114 and the valve retainer 112 also reduces adhesion forces between the valve member 114 and the valve retainer 112. Furthermore, the positioning of the apertures 124 along the inner diametrical 121 of the valve housing and the proximity of the apertures 124 relative to the valve seat 138 allow for faster response time of the shutdown valve assembly 24 during shutdown of the compressor 10 (which reduces backflow of working fluid and reduces reverse rotation of the orbiting scroll 70 during shutdown). Furthermore, the structure of the valve housing 110, valve retainer 112, and valve member 114 improves sound performance (i.e., allows for quieter operation). Furthermore, the valve seat 138 being flat (as opposed to tapered) may reduce Poiseuille flow effect.

With reference to FIGS. 5-8, another shutdown valve assembly 224 is provided that can be incorporated into the compressor 10 instead of the shutdown valve assembly 24. The shutdown valve assembly 224 is disposed at least partially within the discharge recess 95 of the non-orbiting scroll 72 is operable to selectively allow and prevent fluid flow though the discharge passage 90.

Figure 5:
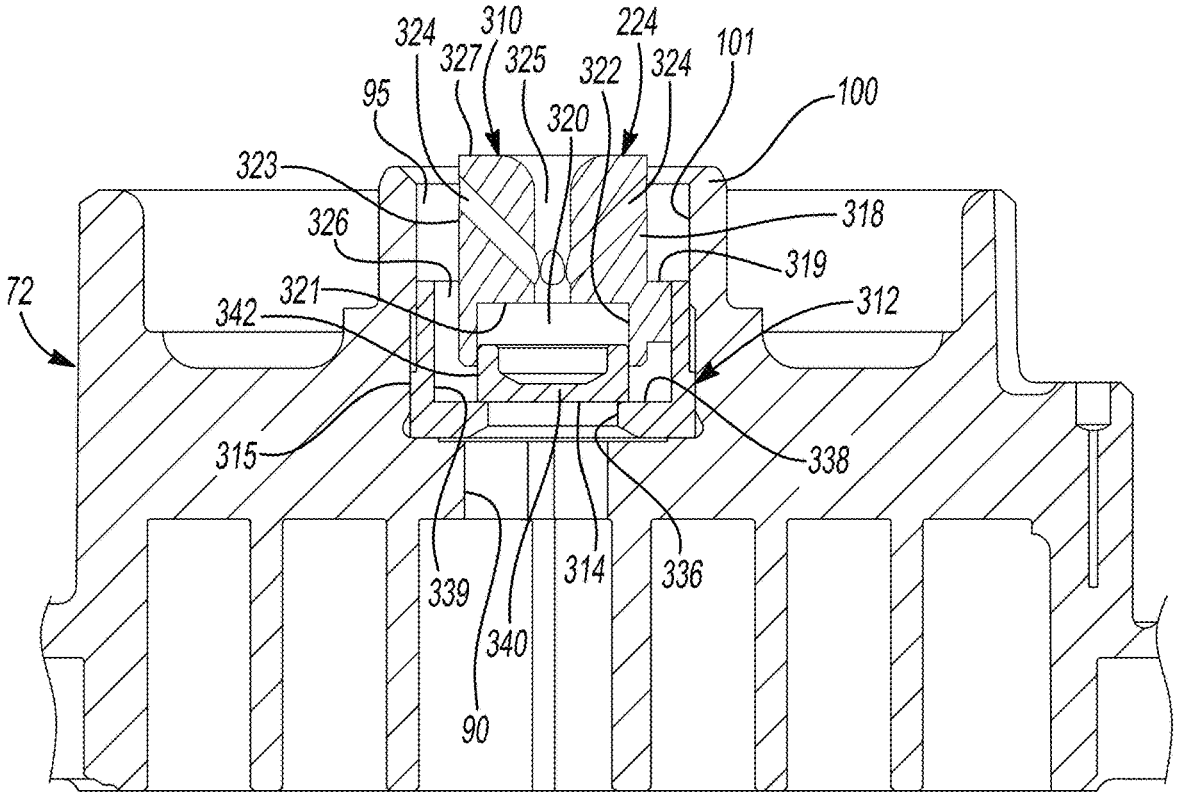
FIG. 5 is a cross-sectional view of the scroll and another shutdown valve assembly in a closed position.
Figure 6:
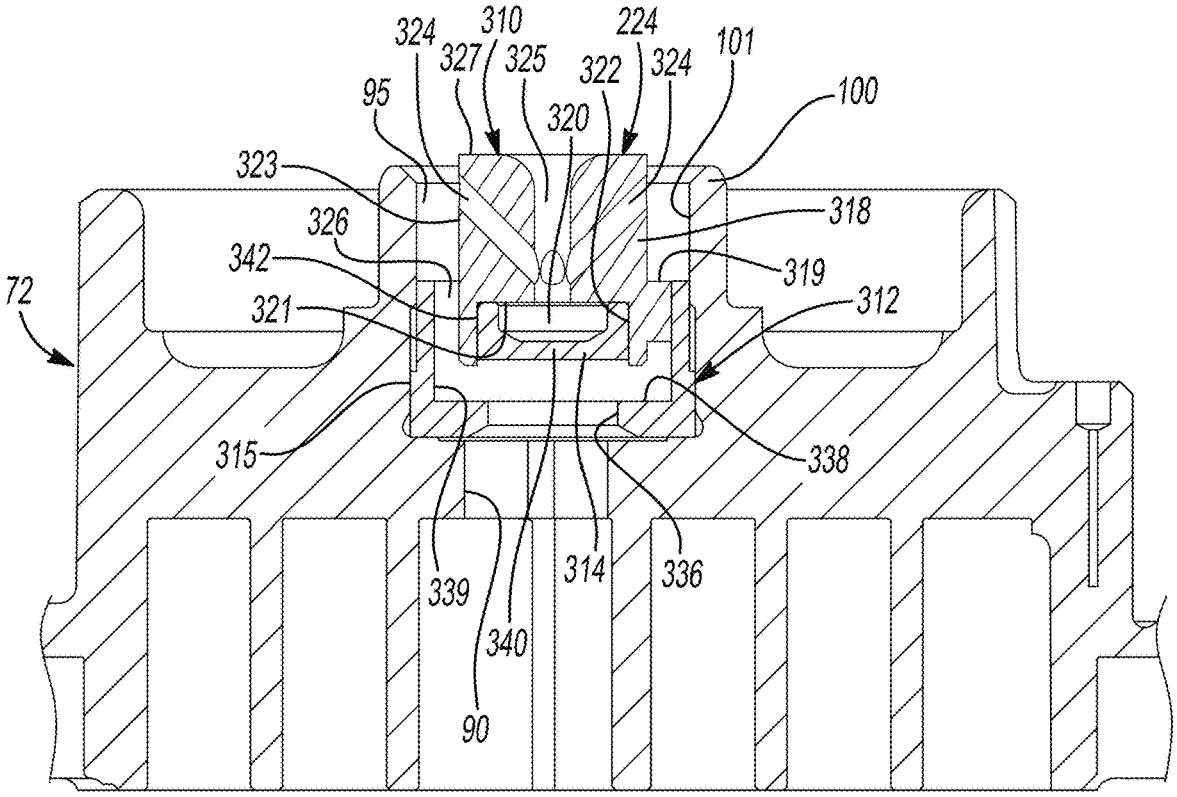
FIG. 6 is a cross-sectional view of the scroll and the shutdown valve assembly of FIG. 5 in an open position.
Figure 7:
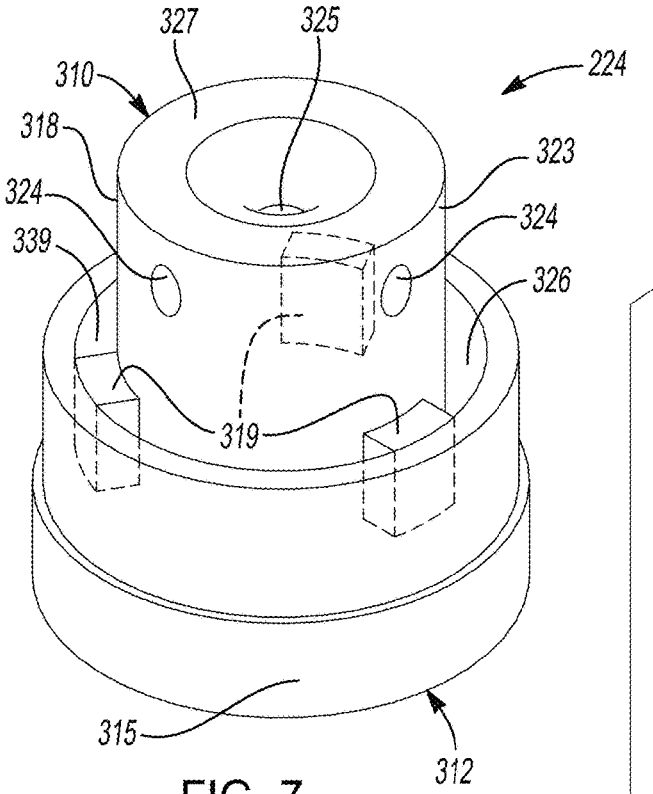
FIG. 7 is a perspective view of the shutdown valve assembly of FIGS. 5 and 6.
Figure 8:
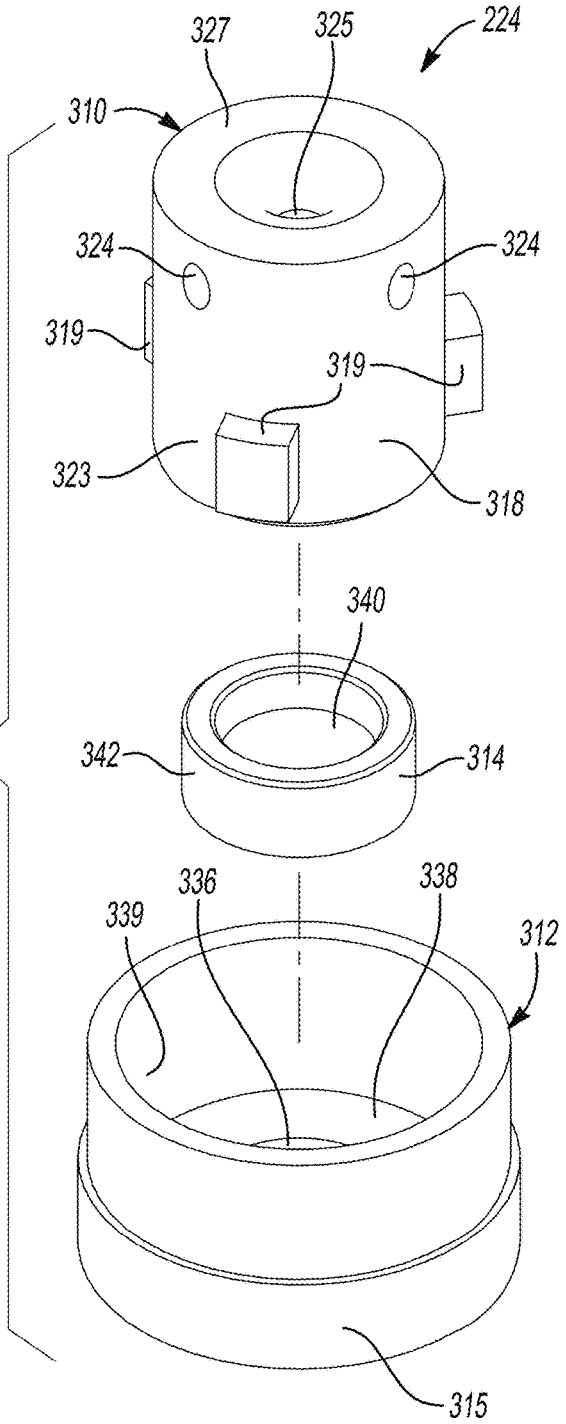
FIG. 8 is an exploded view of the shutdown valve assembly of FIGS. 5-7.

The shutdown valve assembly 224 may include a valve housing 310, a retainer 312, and a valve member 314. The valve member 314 is movable relative to the valve housing 310 and the retainer 312 between a closed position (FIG. 5) and an open position (FIG. 6). When the valve member 314 is in the open position, working fluid is allowed to flow through the shutdown valve assembly 224 between the discharge passage 90 and the discharge chamber 40. When the valve member 314 is in the closed position, working fluid is restricted or prevent from flowing through the shutdown valve assembly 224 thereby restricting or preventing fluid flow between the discharge passage 90 and the discharge chamber 40. Pressure differentials between the discharge passage 90 and the discharge chamber 40 move the valve member 314 between the open and closed positions.

The valve retainer 312 may be a generally cup-shaped body having a radially outer surface 315 that may fixedly engage (e.g., via threaded engagement, press fit, welding, and/or other means) the inner diametrical surface 101 of the hub 100 of the non-orbiting scroll 72. An axial end of the valve retainer 312 may define a valve seat 338 and an opening 336 that extends through the valve seat 338.

The valve housing 310 may include a housing body 318 and a plurality of projections or tabs 319 that extend radially outward from the housing body 318. The housing body 318 may be generally cylindrical and may include a recess 320 (FIGS. 5 and 6) disposed in its lower axial end. The recess 320 reciprocatingly receives the valve member 314 therein. Surface 321 that defines an axial end of the recess 320 acts as a valve stop to limit the upward movement of the valve member 314 and define the fully open position of the valve member 314. A diametrical surface 322 defining the recess 320 may act as a guide surface to guide movement of the valve member 314 between the open and closed positions.

The tabs 319 of the valve housing 310 may fixedly engage (e.g., via threaded engagement, press fit, welding, and/or other means) an inner diametrical surface 339 of the valve retainer 312. The housing body 318 may extend axially upward and out of the valve retainer 312. An outer diametrical surface 323 of the housing body 318 is radially spaced apart from the inner diametrical surface 339 of the valve retainer 312 and the inner diametrical surface 101 of the hub 100. In this manner, the housing body 318, the hub 100, and the valve retainer 312 define an annular gas flow path 326 disposed radially between the inner diametrical surface 101 of the hub 100 and the outer diametrical surface 323 of the housing body 318. Working fluid flows from through the annular gas flow path 326 (i.e., from the discharge passage 90 to the discharge chamber 40) when the valve member 314 is in the open position (FIG. 6). In the closed position (FIG. 5), the valve member 314 blocks fluid from the discharge chamber 40 through from flowing through the annular gas flow path 316 to the discharge passage 90.

The housing body 318 of the valve housing 310 may also include a plurality of apertures 324. The apertures 324 may extend through the outer diametrical surface 323 of the housing body 318 and are in fluid communication with the recess 320. The apertures 324 may be angled (i.e., a longitudinal axis of each aperture 324 may be disposed at a non-parallel and non-perpendicular angle (e.g., a 45-degree angle, for example) relative to the rotational axis of the driveshaft 64). A central aperture 325 may extend axially through axial end 327 of the housing body 318 and may be in fluid communication with the apertures 324 and the recess 320. As shown in FIGS. 5 and 6, the axial end 327 may protrude further upward than the axial end of the hub 100 of the non-orbiting scroll 72.

The valve member 314 shown in the figures is generally cup-shaped and has a U-shaped cross section. The valve member 314 may include a disc-shaped main body 340 and an annular collar 342 extending axially from the main body 340. An axial end of the collar 342 contacts the surface 321 of the valve housing 310 when the valve member 314 is in the open position (FIG. 6), and the opposite axial end of the valve member 314 contacts the valve seat 338 of the retainer 312 when the valve member 314 is in the closed position (FIG. 5). The annular collar 342 of the valve member 314 may be in sliding contact with the inner diametrical surface 322 of the valve housing 310 so that the inner diametrical surface 322 of the valve housing 310 acts as a guide surface as the valve member 314 moves between the open and closed positions. In some configurations, the valve member 314 may be entirely disc-shaped and may not include the annular collar 342.

As described above, during normal operation of the compressor 10, the scrolls 70, 72 compress working fluid (e.g., from the suction pressure to the discharge pressure). Working fluid in the fluid pocket at the radially inner position 115 (e.g., at the discharge pressure) is forced through the discharge passage 90 and through the opening 336 in the retainer 312 to force the valve member 314 into the open position (FIG. 6). With the valve member 314 in the open position, the compressed working fluid may flow from the opening 336 through the annular gas flow path 326, through the discharge passage 44 of the partition 36, and into the discharge chamber 40.

When the compressor 10 is shut down or when the compressor 10 is switched to a low-capacity or zero-capacity operating state (or during any other operating condition in which working fluid in the fluid pocket at the radially inner position 115 is at a lower pressure than working fluid in the discharge chamber 40), working fluid from the discharge chamber 40 (or working fluid at the discharge passage 44 of the partition 36) may flow through the apertures 324, 325 of the valve housing 310 and may force the valve member 314 into the closed position (FIG. 5). As noted above, when the valve member 314 is in the closed position, the annular gas flow path 326 is blocked and the opening 336 in the valve retainer 312 is blocked, thereby restricting or preventing fluid flow through the discharge passage 90 (i.e., to reduce or prevent reverse rotation of the orbiting scroll 70).

The shutdown valve assembly 224 described herein has several advantages over prior-art shutdown valves. For example, the structure of the valve housing 310 and valve member 314 provides less surface area over which the valve member 314 and valve housing 310 contact each other. This reduced contact area reduces lateral oil adhesion force between the valve member 314 and the inner diametrical surface 322 of the valve housing 310. Furthermore, the relatively small contact area between the valve member 314 and the valve retainer 312 also reduces adhesion forces between the valve member 314 and the valve retainer 312. Furthermore, the angled positioning of the apertures 324 in the valve housing 310 (i.e., such that the apertures 324 extend through the outer diametrical surface 323 of the valve housing 310) allows fluid flowing past the opening of the apertures 324 (i.e., fluid flowing up through the annular gas flow path 326) to create a Venturi effect that tends to hold the valve member 314 in the open position and in contact with the surface 321. Furthermore, the shutdown valve assembly 224 achieves faster response time (i.e., faster movement between open and closed position) during shutdown of the compressor 10 (which reduces backflow of working fluid and reduces reverse rotation of the orbiting scroll 70 during shutdown). Furthermore, the structure of the valve housing 310, valve retainer 312, and valve member 314 improves sound performance (i.e., allows for quieter operation). Furthermore, the valve seat 338 being flat (as opposed to tapered) may reduce Poiseuille flow effect.

With reference to FIGS. 9-12, another shutdown valve assembly 424 is provided that can be incorporated into the compressor 10 instead of the shutdown valve assembly 24, 224. The shutdown valve assembly 424 is disposed partially within the discharge recess 95 of the non-orbiting scroll 72 is operable to selectively allow and prevent fluid flow though the discharge passage 90.

Figure 9:
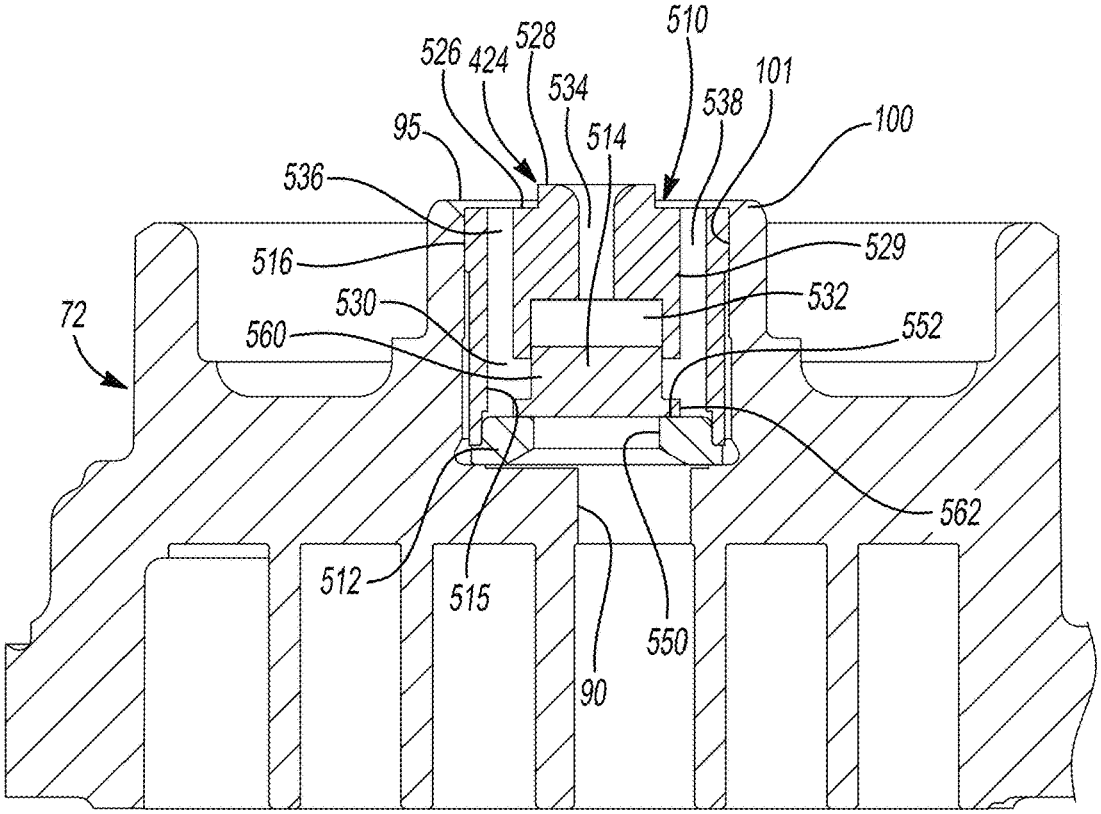
FIG. 9 is a cross-sectional view of the scroll and yet another shutdown valve assembly in a closed position.
Figure 10:
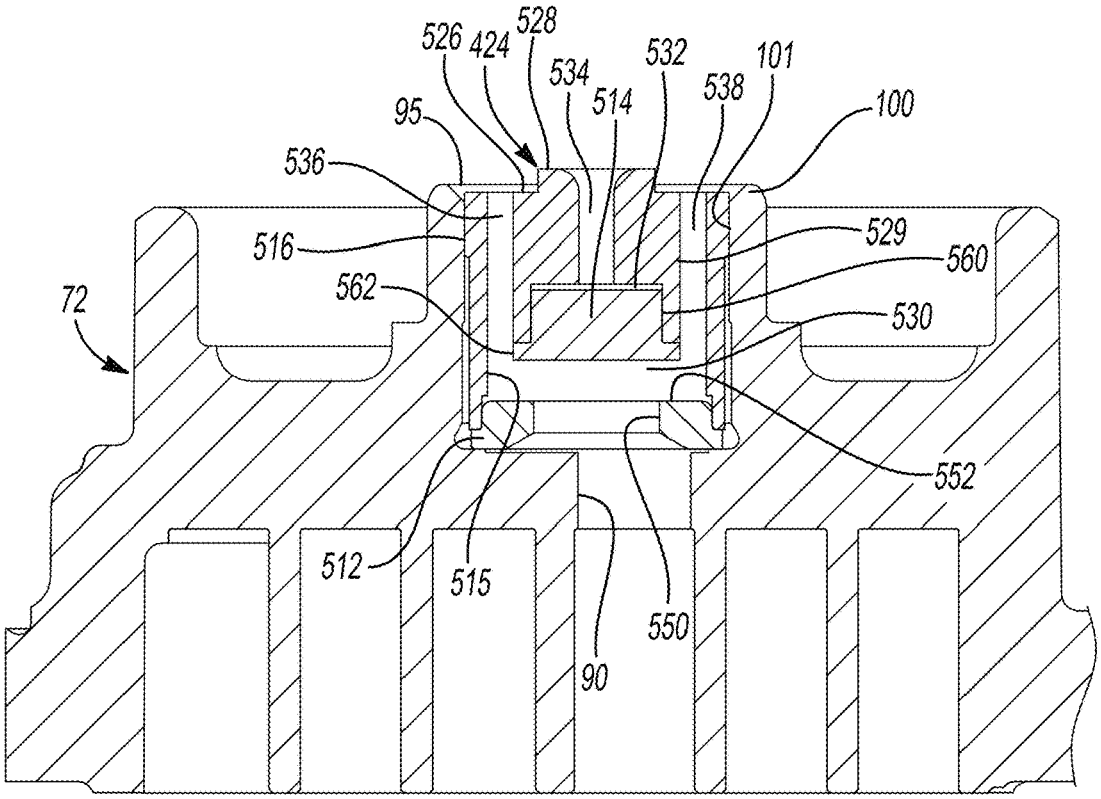
FIG. 10 is a cross-sectional view of the scroll and the shutdown valve assembly of FIG. 9 in an open position.
Figure 11:
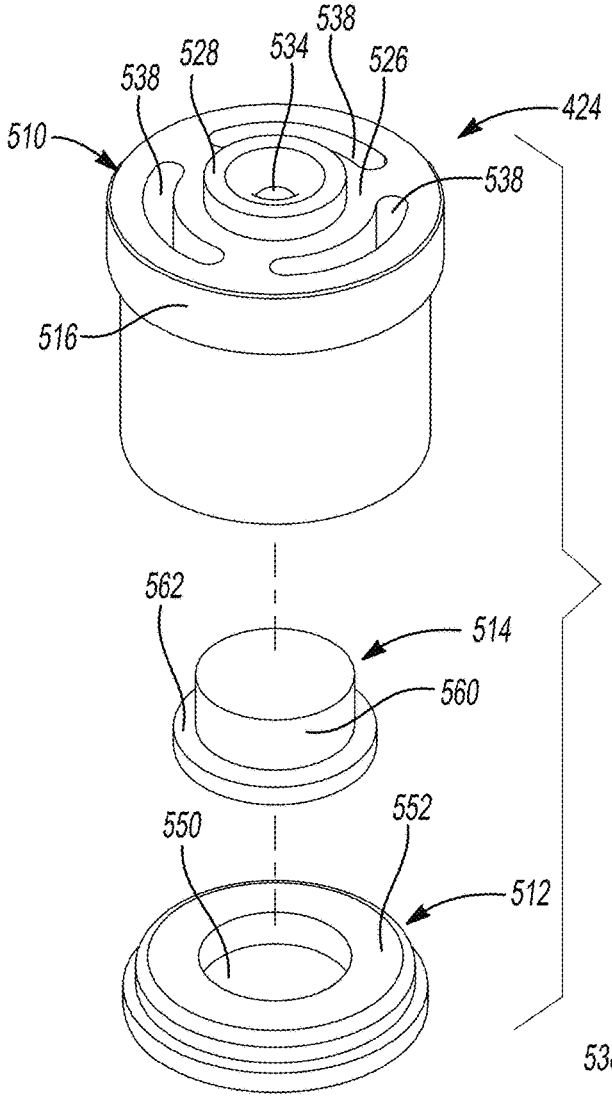
FIG. 11 is an exploded view of the shutdown valve assembly of FIGS. 9 and 10.
Figure 12:
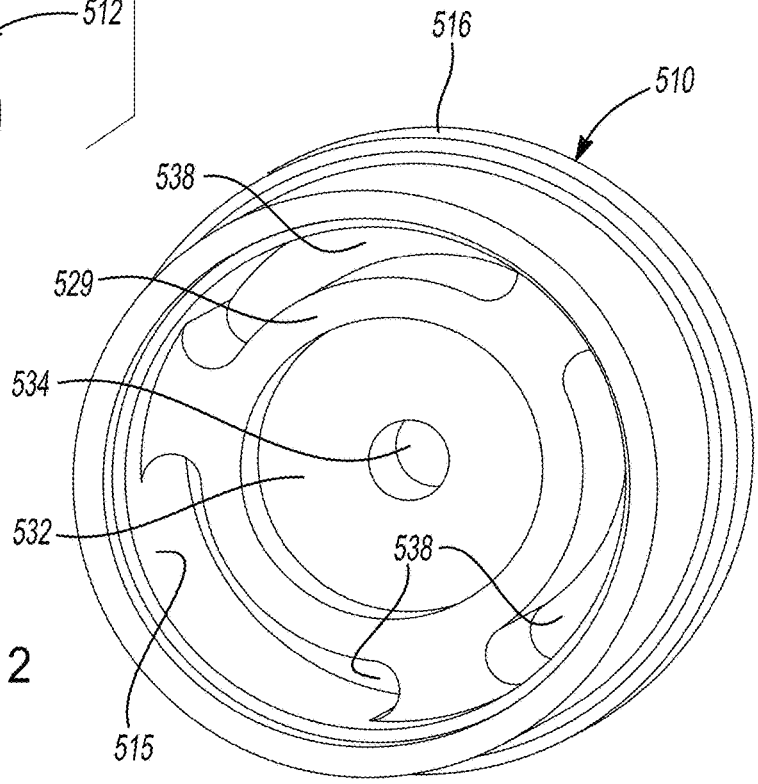
FIG. 12 is a perspective view of a valve housing of the shutdown valve assembly of FIGS. 9-11.

The shutdown valve assembly 424 may include a valve housing 510, a retainer 512, and a valve member 514. The valve member 514 is movable relative to the valve housing 510 and the retainer 512 between a closed position (FIG. 9) and an open position (FIG. 10). When the valve member 514 is in the open position, working fluid is allowed to flow through the shutdown valve assembly 424 between the discharge passage 90 and the discharge chamber 40. When the valve member 514 is in the closed position, working fluid is restricted or prevent from flowing through the shutdown valve assembly 424 thereby restricting or preventing fluid flow between the discharge passage 90 and the discharge chamber 40. Pressure differentials between the discharge passage 90 and the discharge chamber 40 move the valve member 514 between the open and closed positions.

The valve housing 510 may be a generally cylindrical body having an inner diametrical surface 515 and a radially outermost diametrical surface 516 that is fixedly engaged (e.g., via threaded engagement, press fit, and/or other means) with the inner diametrical surface 101 of the hub 100 of the non-orbiting scroll 72. An axial end face 526 of the valve housing 510 extends radially inward from the diametrical surface 516. The axial end face 526 may include an annular projection 528 that extends from the axial end face 526 in an axial direction toward the discharge chamber 40 (i.e., the annular projection 528 extends axially out of the hub 100 such that the distal axial end of the annular projection 528 is disposed axially above the axial end of the hub 100).

A projection 529 extends from the axial end face 526 in an axial direction (i.e., a direction opposite the direction in which the annular projection 528 extends) into an interior volume 530 of the valve housing 510 (i.e., the interior volume 530 defined by the inner diametrical surface 515). That is, the projection 529 extends from the axial end face 526 toward the discharge passage 90. The projection 529 shown in the figures is cylindrical, but it will be appreciated that the projection 529 could have any other suitable shape such as frustoconical or rectangular prism, for example. The projection 529 may include a recess 532 that reciprocatingly receives the valve member 514. An aperture 534 may extend through the projections 528, 529 and may be in fluid communication with the recess 532. An outer diametrical surface of the projection 529 may be radially spaced apart from the inner diametrical surface 515 of the valve housing 510 such that an annular gas flow path 536 is formed therebetween. Curved apertures 538 formed in the axial end face 526 of the valve housing 510 provide fluid communication between the annular gas flow path 536 and the discharge chamber 40.

The retainer 512 may be fixed relative to the valve housing 510 and may extend into the interior volume 530 of the valve housing 510. The retainer 512 may be an annular member and includes an opening 550 that provides fluid communication between the discharge passage 90 and the interior volume 530 of the valve housing 510. The retainer 512 may define an annular valve seat 552 that contacts the valve member 514 in the closed position (as shown in FIG. 9). When the valve member 514 is in the open position (FIG. 10), the valve member 514 is spaced apart from the valve seat 552 so that fluid can flow from the discharge passage 90 through the opening 550, through the annular gas flow path 536, through the curved apertures 538, and into the discharge chamber 40.

The valve member 514 may include a disc-shaped body 560 and a flange 562 that extends radially outward from the body 560. The body 560 is received in the recess 532 of the valve housing 510 and is in sliding contact with an inner diametrical surface that defines the recess 532. The flange 562 contacts an axial end of the projection 529 when the valve member 514 is in the open position. The flange 562 contacts the valve seat 552 when the valve member 514 is in the closed position.

As described above, during normal operation of the compressor 10, the scrolls 70, 72 compress working fluid (e.g., from the suction pressure to the discharge pressure). Working fluid in the fluid pocket at the radially inner position 115 (e.g., at the discharge pressure) is forced through the discharge passage 90 and through the opening 550 in the retainer 512 to force the valve member 514 into the open position (FIG. 10). With the valve member 514 in the open position, the compressed working fluid may flow from the opening 550 through the annular gas flow path 536, through the curved apertures 538, and into the discharge chamber 40.

When the compressor 10 is shut down or when the compressor 10 is switched to a low-capacity or zero-capacity operating state (or during any other operating condition in which working fluid in the fluid pocket at the radially inner position 115 is at a lower pressure than working fluid in the discharge chamber 40), working fluid from the discharge chamber 40 (or working fluid at the discharge passage 44 of the partition 36) may flow through the aperture 534 of the valve housing 510 and may force the valve member 514 into the closed position (FIG. 9). As noted above, when the valve member 514 is in the closed position, the annular gas flow path 536 is blocked and the opening 550 in the valve retainer 512 is blocked, thereby restricting or preventing fluid flow through the discharge passage 90 (i.e., to reduce or prevent reverse rotation of the orbiting scroll 70).

The shutdown valve assembly 424 described herein has several advantages over prior-art shutdown valves. For example, the structure of the valve housing 510 and valve member 514 provides less surface area over which the valve member 514 and valve housing 510 contact each other. This reduced contact area reduces lateral oil adhesion force between the valve member 514 and the valve housing 310. Furthermore, the relatively small contact area between the valve member 514 and the valve retainer 512 also reduces adhesion forces between the valve member 514 and the valve retainer 512. Furthermore, the shutdown valve assembly 424 achieves faster response time (i.e., faster movement between open and closed position) during shutdown of the compressor 10 (which reduces backflow of working fluid and reduces reverse rotation of the orbiting scroll 70 during shutdown). Furthermore, the annular projection 528 that extends axially above the hub 100 and axially above the curved apertures 538 helps to prevent backflow of fluid through the aperture 534 during normal operating conditions (i.e., conditions in which the valve member 514 is in the open position), which reduces rattling of the valve member 514 and allows for quieter operation.

With reference to FIGS. 13-17, another shutdown valve assembly 624 is provided that can be incorporated into the compressor 10 instead of the shutdown valve assembly 24, 224, 424. The shutdown valve assembly 624 is disposed at least partially within the discharge recess 95 of the non-orbiting scroll 72 is operable to selectively allow and prevent fluid flow though the discharge passage 90.

The shutdown valve assembly 624 may include a valve housing 710, a retainer 712, and a valve member 714. The valve member 714 is movable relative to the valve housing 710 and the retainer 712 between a closed position (FIG. 13) and an open position (FIG. 14). When the valve member 714 is in the open position, working fluid is allowed to flow through the shutdown valve assembly 624 between the discharge passage 90 and the discharge chamber 40. When the valve member 714 is in the closed position, working fluid is restricted or prevent from flowing through the shutdown valve assembly 624 thereby restricting or preventing fluid flow between the discharge passage 90 and the discharge chamber 40. Pressure differentials between the discharge passage 90 and the discharge chamber 40 move the valve member 714 between the open and closed positions.

The valve housing 710 may be a generally cylindrical body having an inner surface 715, a radially outermost diametrical surface 716, and an annular ledge 717. The radially outermost diametrical surface 716 is fixedly engaged (e.g., via threaded engagement, press fit, and/or other means) with the inner diametrical surface 101 of the hub 100 of the non-orbiting scroll 72. The inner surface 715 defines an interior volume 718 of the valve housing 710. The inner surface 715 defines a plurality of scallop-shaped apertures 720 that extend through an axial end face 722 of the valve housing 710. The ledge 717 includes an opening 724 and defines a valve seat 726. The opening 724 is in fluid communication with the discharge passage 90. The valve seat 726 contacts the valve member 714 in the closed position to prevent fluid flow through the opening 724 and discharge passage 90.

Figure 15:
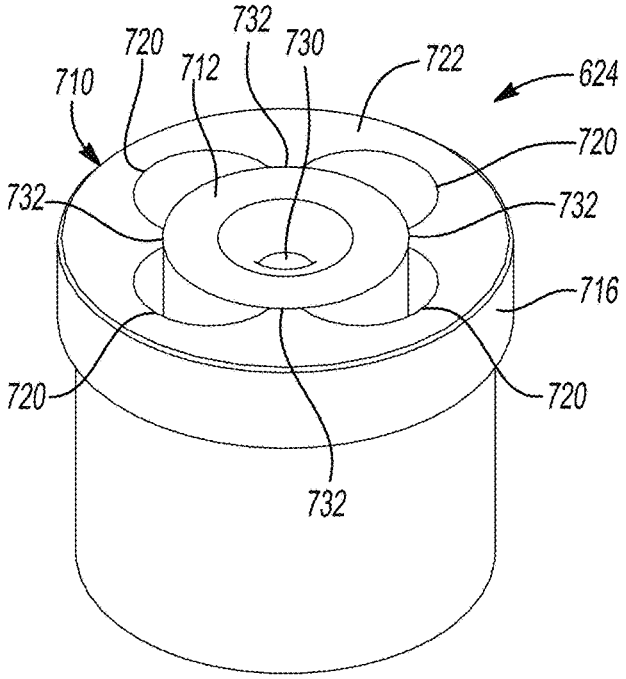
FIG. 15 is a perspective view of the shutdown valve assembly of FIGS. 13 and 14.
Figure 16:
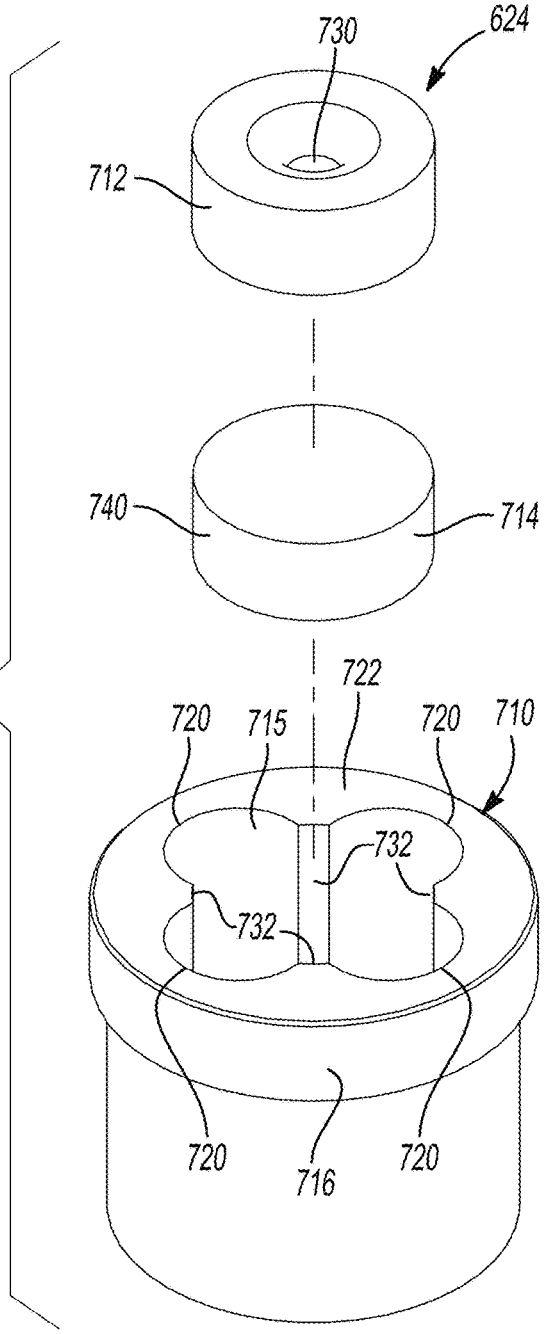
FIG. 16 is an exploded view of the shutdown valve assembly of FIGS. 13-15.
Figure 17:
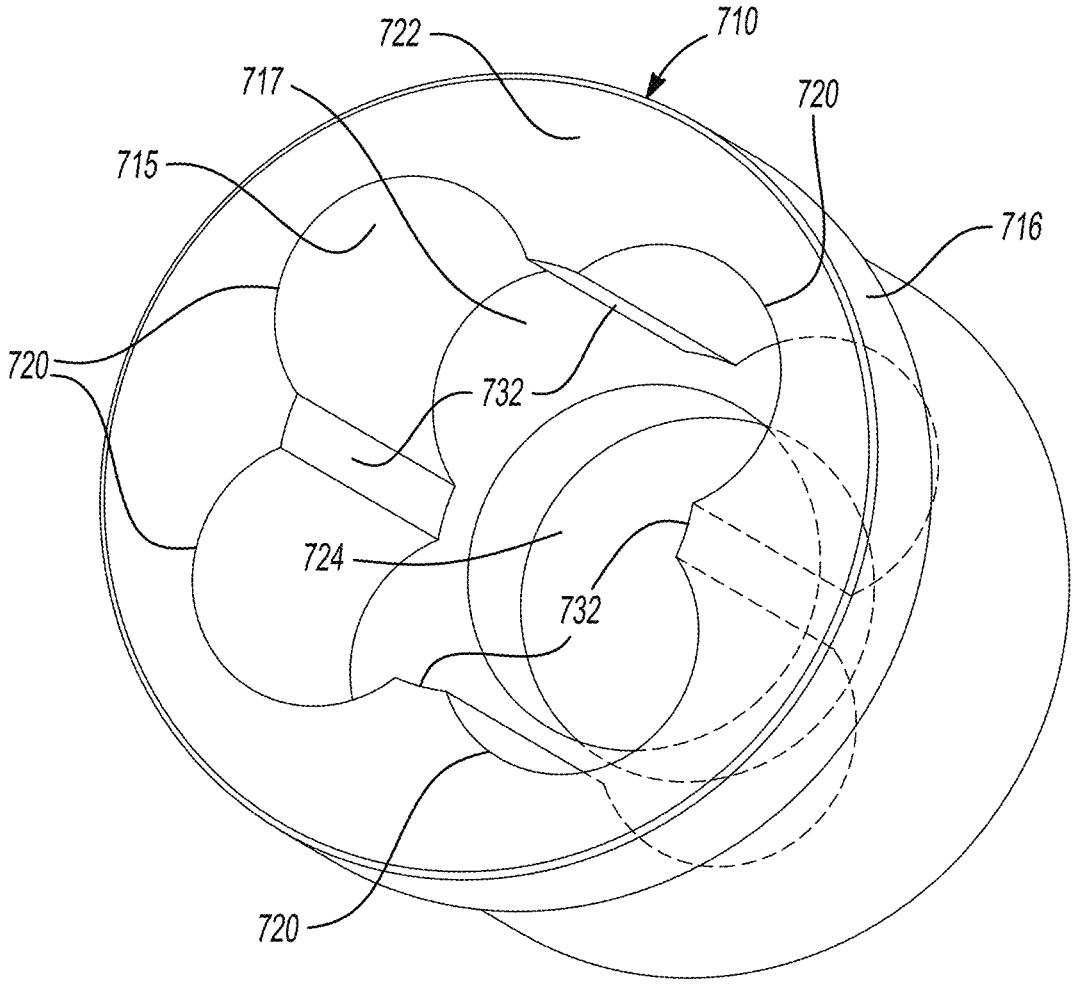
FIG. 17 is a perspective view of a valve housing of the shutdown valve assembly of FIGS. 13-16.

The valve retainer 712 may be a disc-shaped body having a central aperture 730. An outer diametrical surface of the valve retainer 712 may fixedly engage (e.g., via threaded engagement, press-fit, welding, and/or other means) a plurality of guide surfaces 732 of the inner surface 715, as shown in FIG. 15. The valve retainer 712 acts as a valve stop that defines the fully open position of the valve member 714 (i.e., the valve member 714 contacts the valve retainer 712 in the open position).

The valve member 714 may be a disc-shaped body. An outer diametrical surface 740 of the valve member 714 may slidingly contact the guide surfaces 732 of the valve housing 710.

As described above, during normal operation of the compressor 10, the scrolls 70, 72 compress working fluid (e.g., from the suction pressure to the discharge pressure). Working fluid in the fluid pocket at the radially inner position 115 (e.g., at the discharge pressure) is forced through the discharge passage 90 and through the opening 724 in the valve housing 710 to force the valve member 714 into the open position (FIG. 14). With the valve member 714 in the open position, the compressed working fluid may flow from the opening 724 through the interior volume 718, through the apertures 720, and into the discharge chamber 40.

Figure 13:
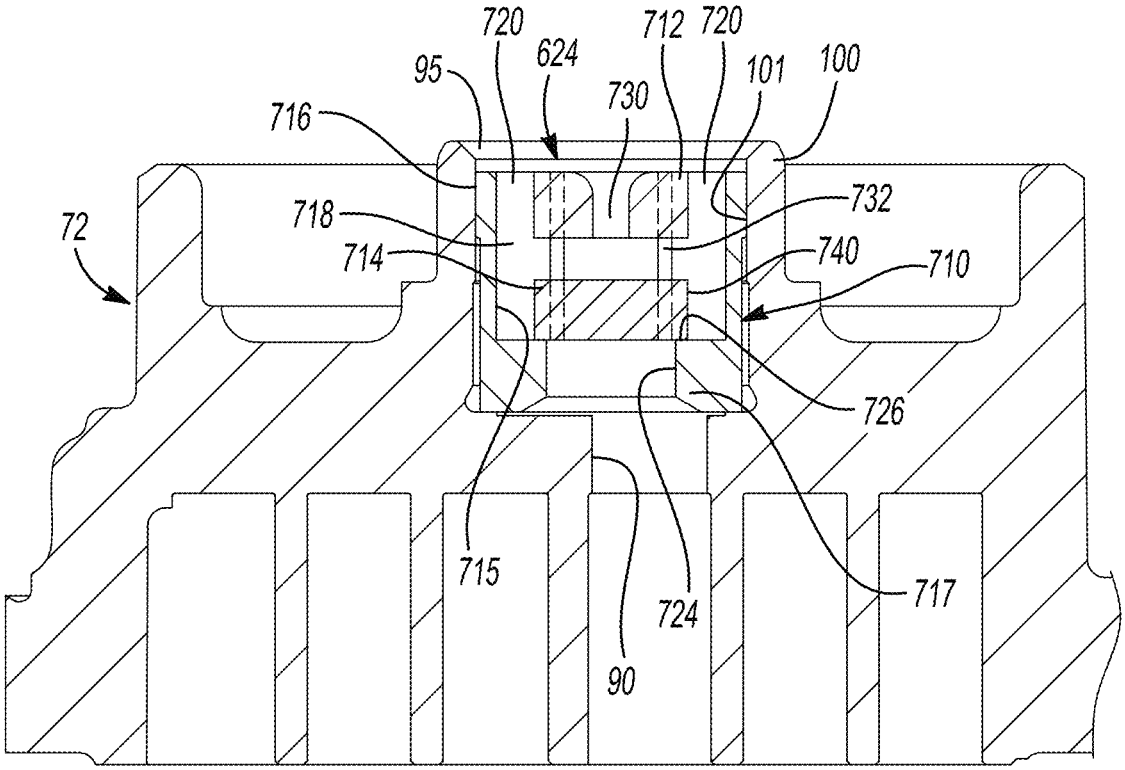
FIG. 13 is a cross-sectional view of the scroll and still another shutdown valve assembly in a closed position.
Figure 14:
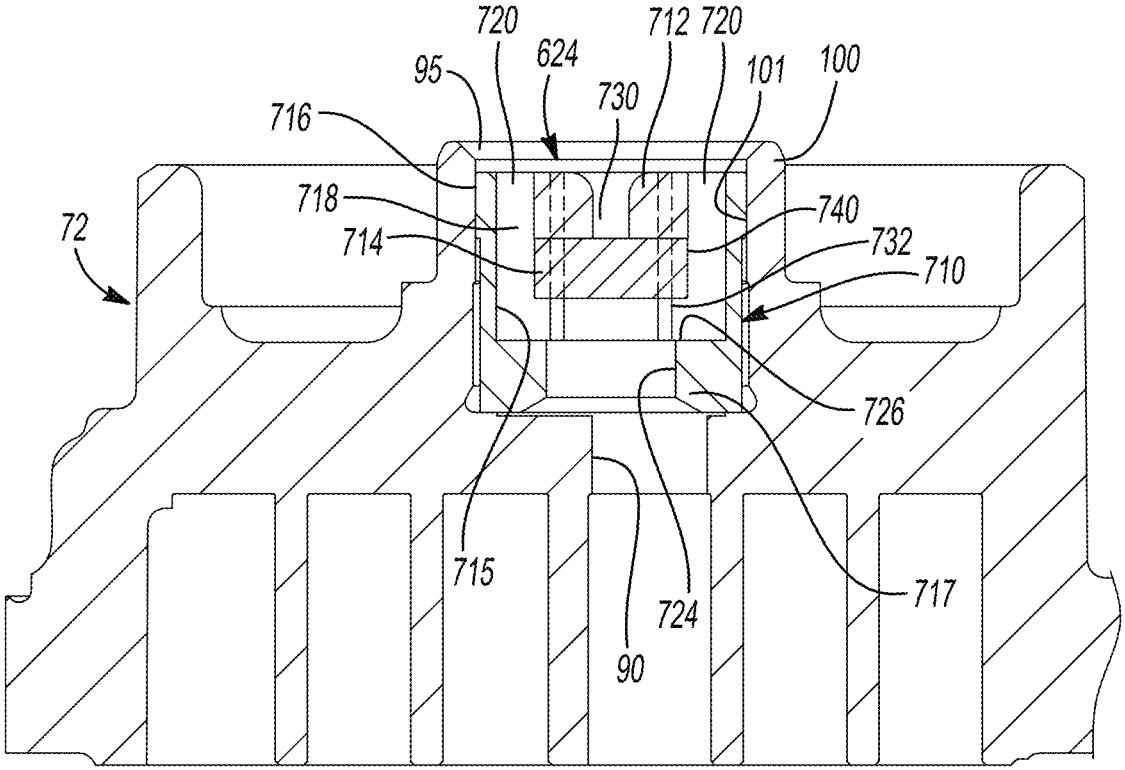
FIG. 14 is a cross-sectional view of the scroll and the shutdown valve assembly of FIG. 13 in an open position.

When the compressor 10 is shut down or when the compressor 10 is switched to a low-capacity or zero-capacity operating state (or during any other operating condition in which working fluid in the fluid pocket at the radially inner position 115 is at a lower pressure than working fluid in the discharge chamber 40), working fluid from the discharge chamber 40 (or working fluid at the discharge passage 44 of the partition 36) may flow through the aperture 730 of the valve retainer 712 and may force the valve member 714 into the closed position (FIG. 13). As noted above, when the valve member 714 is in the closed position, the opening 724 in the valve housing 710 is blocked, thereby restricting or preventing fluid flow through the discharge passage 90 (i.e., to reduce or prevent reverse rotation of the orbiting scroll 70).

The shutdown valve assembly 624 described herein has several advantages over prior-art shutdown valves. For example, the structure of the valve housing 710 and valve member 714 provides less surface area over which the valve member 714 and valve housing 710 contact each other. This reduced contact area reduces lateral oil adhesion force between the valve member 714 and the guide surfaces 732 of the valve housing 710. Furthermore, the relatively small contact area between the valve member 714 and the valve seat 726 also reduces adhesion forces between the valve member 714 and the valve housing 710. Furthermore, the shutdown valve assembly 624 achieves faster response time (i.e., faster movement between open and closed position) during shutdown of the compressor 10 (which reduces backflow of working fluid and reduces reverse rotation of the orbiting scroll 70 during shutdown).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a first scroll having a first end plate and a first spiral wrap extending from the first end plate;

a second scroll having a second end plate and a second spiral wrap extending from the second end plate and meshing with the first spiral wrap to define fluid pockets therebetween, wherein the second end plate includes a discharge passage and a discharge recess; and a valve assembly disposed at least partially within the discharge recess and including a valve housing fixed relative to the second scroll, a valve retainer fixed relative to the valve housing, and a valve member movably received in the valve housing, wherein:

the valve member is movable relative to the valve housing and valve retainer between an open position and a closed position, when the valve member is in the open position, fluid is allowed to flow through the discharge passage and the valve assembly, when the valve member is in the closed position, fluid flow through the discharge passage and the valve assembly is restricted, and the valve housing includes a plurality of angled apertures that are angled relative to a direction in which the valve member moves between the open and closed positions, and when the valve member is in the open position, the valve member uncovers the angled apertures to allow fluid communication between the discharge passage and an annular gas flow path, wherein the annular gas flow path is defined by and disposed radially between an inner diametrical surface of a hub of the second scroll and an outer diametrical surface of the valve housing.

2. The compressor of claim 1, wherein the angled apertures in the valve housing extend between an inner diametrical surface of the valve housing and the outer diametrical surface of the valve housing.

3. The compressor of claim 2, wherein the openings of the angled apertures at the inner diametrical surface of the valve housing are disposed between the valve member and the discharge passage when the valve member is in the open position.

4. The compressor of claim 3, wherein a radially outer surface of the valve member covers the openings of the angled apertures when the valve member is in the closed position.

5. The compressor of claim 4, wherein the radially outer surface of the valve member slidingly contacts the inner diametrical surface of the valve housing as the valve member moves between the open and closed positions.

6. The compressor of claim 3, wherein the valve housing includes a gas-return aperture, and wherein the gas-return aperture and the angled apertures are in fluid communication with a discharge-pressure region of the compressor.

7. The compressor of claim 6, wherein the valve housing includes a projection that extends into an interior volume of the valve housing and includes an axial end surface that defines a stop for the valve member in the open position.

8. The compressor of claim 7, wherein the gas-return aperture extends through the axial end surface of the projection.

9. The compressor of claim 1, wherein the valve retainer defines a valve seat that contacts the valve member when the valve member is in the closed position, and wherein the valve seat defines an opening that is in fluid communication with the discharge passage.

10. The compressor of claim 1, wherein:

the valve housing includes a base portion and a body portion, the base portion has a larger diameter than the body portion and fixedly engages an inner diametrical surface of a hub of the second scroll, the angled apertures are disposed in the body portion.

11. A compressor comprising:

a first scroll having a first end plate and a first spiral wrap extending from the first end plate;

a second scroll having a second end plate and a second spiral wrap extending from the second end plate and meshing with the first spiral wrap to define fluid pockets therebetween, wherein the second end plate includes a discharge passage; and a valve assembly including a valve housing fixed relative to the second scroll, a valve retainer fixed relative to the valve housing, and a valve member movably received in the valve housing, wherein:

the valve housing includes a plurality of angled apertures that are angled relative to a direction in which the valve member moves between the open and closed positions, the valve member is movable relative to the valve housing and valve retainer between an open position and a closed position, when the valve member is in the open position, fluid is allowed to flow through the discharge passage and through the angled apertures in the valve housing, when the valve member is in the closed position, fluid flow through the discharge passage and the angled apertures is restricted, and when the valve member is in the open position, the valve member uncovers the angled apertures to allow fluid communication between the discharge passage and an annular gas flow path, wherein the annular gas flow path is defined by and disposed radially between an inner diametrical surface of a hub of the second scroll and an outer diametrical surface of the valve housing.

12. The compressor of claim 11, wherein the angled apertures in the valve housing extend between an inner diametrical surface of the valve housing and the outer diametrical surface of the valve housing.

13. The compressor of claim 12, wherein the openings of the angled apertures at the inner diametrical surface of the valve housing are disposed between the valve member and the discharge passage when the valve member is in the open position.

14. The compressor of claim 13, wherein a radially outer surface of the valve member covers the openings of the angled apertures when the valve member is in the closed position.

15. The compressor of claim 14, wherein the radially outer surface of the valve member slidingly contacts the inner diametrical surface of the valve housing as the valve member moves between the open and closed positions.

16. The compressor of claim 13, wherein the valve housing includes a gas-return aperture, and wherein the gas-return aperture and the angled apertures are in fluid communication with a discharge-pressure region of the compressor.

17. The compressor of claim 16, wherein the valve housing includes a projection that extends into an interior volume of the valve housing and includes an axial end surface that defines a stop for the valve member in the open position.

18. The compressor of claim 17, wherein the gas-return aperture extends through the axial end surface of the projection.

19. The compressor of claim 11, wherein the valve retainer defines a valve seat that contacts the valve member when the valve member is in the closed position, and wherein the valve seat defines an opening that is in fluid communication with the discharge passage.

20. The compressor of claim 11, wherein:

the valve housing includes a base portion and a body portion, the base portion has a larger diameter than the body portion and fixedly engages the inner diametrical surface of the hub of the second scroll, the angled apertures are disposed in the body portion.

* * * * *